US011980267B2

(12) United States Patent
Martin-Sewall et al.

(10) Patent No.: US 11,980,267 B2
(45) Date of Patent: May 14, 2024

(54) COMBINATION MEAL AND TO-GO BOX

(71) Applicant: Aaron Sewall, Portland, OR (US)

(72) Inventors: Stephanie Martin-Sewall, Portland, OR (US); Aaron Sewall, Portland, OR (US); Toren Orzeck, Portland, OR (US); Alexander Slavitz, Portland, OR (US)

( * ) Notice: Subject to any disclaimer, the term of this patent is extended or adjusted under 35 U.S.C. 154(b) by 432 days.

(21) Appl. No.: 17/249,850

(22) Filed: Mar. 16, 2021

(65) Prior Publication Data

US 2022/0295959 A1 Sep. 22, 2022

(51) Int. Cl.

| | |
|---|---|
| ***A45C 11/20*** | (2006.01) |
| ***B65D 21/08*** | (2006.01) |
| ***B65D 25/08*** | (2006.01) |
| ***B65D 43/22*** | (2006.01) |
| ***B65D 81/38*** | (2006.01) |

(52) U.S. Cl.

CPC ..... *A45C 11/20* (2013.01); *B65D 21/086* (2013.01); *B65D 25/08* (2013.01); *B65D 43/22* (2013.01); *B65D 81/3818* (2013.01)

(58) Field of Classification Search

CPC ..... A45C 11/20; B65D 21/068; B65D 25/08; B65D 43/22; B65D 81/3818; Y10T 292/096; E05B 65/5238

See application file for complete search history.

(56) References Cited

U.S. PATENT DOCUMENTS

| | | | | |
|---|---|---|---|---|
| 3,337,077 | A * | 8/1967 | Wheaton, Jr. | B65D 43/022 206/525 |
| 5,188,234 | A * | 2/1993 | Fukuda | A45C 11/20 206/541 |
| 8,985,382 | B2 | 3/2015 | Vernon et al. | |
| 9,926,105 | B2 | 3/2018 | Tsui | |
| 11,279,519 | B2 | 3/2022 | Tsui | |
| 11,377,257 | B2 * | 7/2022 | Siao | B65D 21/083 |
| 2004/0035143 | A1 | 2/2004 | Mogil | |
| 2010/0147015 | A1 * | 6/2010 | Vanderberg | F25D 3/06 220/666 |
| 2011/0284554 | A1 * | 11/2011 | Ray | B65D 51/28 220/574.1 |
| 2013/0181000 | A1 * | 7/2013 | Miksovsky | B65D 1/40 220/780 |
| 2019/0233177 | A1 * | 8/2019 | Han | B65D 81/3818 |

FOREIGN PATENT DOCUMENTS

| | | |
|---|---|---|
| SE | 543 032 C2 | 3/2020 |

* cited by examiner

*Primary Examiner* — Anthony D Stashick
*Assistant Examiner* — Blaine G Neway
(74) *Attorney, Agent, or Firm* — Howard Russell

(57) ABSTRACT

A modular, insulated, configurable combination meal and to-go box for facilitating ecologically responsible and reusable storage and transport of food and other items, with a double-wall-construction lid and utensil tray, an insulated double-wall-construction base member having sidewalls and a base, a removable divider, and a removable flexible shuttle member with a shuttle member lid that can form three configurations: 1) within the double-wall-construction base member; 2) extended to substantially fill the insulated double-wall-construction base member; and 3) extended to any multiple volume shapes of the shuttle member and kept outside of the insulated double-wall-construction base member.

12 Claims, 23 Drawing Sheets

COMBINATION MEAL AND TO-GO BOX

CONTINUITY AND CLAIM OF PRIORITY

This is an original U.S. patent application.

FIELD

The invention relates to food containers, and more specifically it relates to a portable, reusable, insulated, combination meal and to-go box.

BACKGROUND

The transport of food items for personal consumption has included the need for maintaining the proper temperature, hot or cold, of the food. Insulated containers have been provided that allow storage while transporting the food, but these containers have been bulky, and when the food is placed in a refrigerator for longer storage, it has been necessary to dedicate a larger space within the refrigerator, or to transfer the food to a smaller, less insulated container. In addition, the insulated containers have been unsuitable for use during reheating of the food, requiring again a separate container for such reheating operations.

Other food container providers have focused on providing convenient, stackable food containers that are easily transported and suitable for multiple types of food. Those containers, except for traditional insulated mugs holding coffee, hot chocolate, soup, and the like, commonly have been made of plastic, glass, or single-wall metal; or they have not been sufficiently insulated, and therefore they have not of themselves maintained temperatures for long for safe food storage or for enjoyment of food at desired temperatures. And because such containers have included multiple components of non-matching size (e.g., lids, heating container, insulated container, utensil holder), or which were otherwise not easily combined into an integrated unit, transporting them has required a carrying sack or other conveyance that has been awkward to use.

Restaurants have provided a means, such as to-go boxes, to-go cups, and other to-go food containers (e.g., Styrofoam clamshell containers), to transport uneaten left-over food to the customer's home for later eating. Such means of transport has typically involved disposable or one-time use temporary packaging, and as such, together with the fact that often such containers have been made with materials considered unsuitable to a clean environment, these means of transport have been found to be wasteful and otherwise hazardous to the environment. So, while the insulation of such prior means of transport has been barely adequate for maintaining food temperature for even a short period of time, the use of disposable packaging also has not been ecologically sound. And this is not to mention the extra cost that such non-reusable packaging has involved for restaurants, delicatessens, and other retail food establishments. Not only have left-overs been contained in such to-go containers, but food providers have also commonly used such disposable packaging and containers in filling other customer to-go food orders, adding to the volume of waste that has been harmful to the environment.

Therefore, therefore a device is needed that would be fully insulated for maintaining food temperature during transport, that would also allow easy storage, reheating, and consumption of the food with packed, readily available, utensils, without requiring the use of additional containers, and that would also encourage good environmental stewardship through reuse, thus reducing the need for disposable containers.

SUMMARY

In accordance with a first aspect and embodiment of the disclosure, a modular, insulated combination meal and to-go box is provided that is adapted for facilitating ecologically responsible and reusable storage and transport of food and other items, comprising: an insulated double-wall-construction base member having a double-wall-construction base and double-wall-construction sidewalls having a top portion, the insulated double-wall-construction base member open at the top portion and further comprising a smooth upper rim at the top portion, the insulated double-wall-construction base member adapted for holding solids and liquids, the insulated double-wall-construction base member being insulated by a vacuum within the double-wall-construction base and the double-wall-construction sidewalls, and a removable divider adapted for separating food or other items within the insulated double-wall-construction base member. The insulated double-wall-construction base member is preferably made of stainless-steel, though any other material known in the art suitable to the purpose may be used. The removable divider is preferably made of food-grade silicone, though any other suitable material known in the art may be used.

Further, in accordance with this aspect and embodiment of the disclosure, there is also provided a pliable, washable, reusable, collapsible shuttle member, the shuttle member further comprising upper edges and a shuttle member lid comprising a top side and a bottom side, the bottom side comprising a sealing groove at an inner portion thereof and adapted to seal with the upper edges of the shuttle member, the shuttle member lid further comprising an outer portion thereof optionally adapted to seal with the smooth upper rim of the insulated double-wall-construction base member, the shuttle member being adapted to expand and collapse to provide multiple configurations and uses within or without the insulated double-wall-construction base member. The shuttle member lid and the shuttle member are preferably made of food-grade silicone, though any other suitable material known in the art may be used.

Further, the shuttle member lid may be optionally adapted for sealing and protecting any items within the insulated double-wall-construction base member against contamination. In another embodiment of the disclosure, the shuttle member lid may comprise a top side and a bottom side, the bottom side comprising a sealing ridge adapted to seal with a sealing grooves of upper edges of the shuttle member, the shuttle member being thus adapted for sealing and protecting any items within the shuttle member and the insulated double-wall-construction base member against contamination or spillage when the shuttle member lid and the shuttle member are engaged in a closing relationship with the insulated double-wall-construction base member.

In another preferred embodiment of the disclosure, the shuttle member lid may further comprise a circumferential mote on the top side of the shuttle member lid formed by inner and outer circumferential mote sidewalls, the outer mote side wall forming a circumferential ridge adapted for being received and removably retained in a circumferential groove formed in an upper wall portion of the shuttle member. In this embodiment, the circumferential ridge and the circumferential groove are adapted for each attachment and detachment of the shuttle member lid from the shuttle member to prevent compression of the shuttle member while attaching or detaching the shuttle member lid to prevent collapse and spillage of any items within the shuttle member. The circumferential ridge (appearing as an outwardly pointing arrow point) of the shuttle member lid is positioned perpendicular to the outer peripheral wall portion of the circumferential mote (as well as an upper shuttle member wall portion during a sealed condition) and forms a seal with the circumferential groove of the shuttle member that is found in the upper shuttle member wall portion. Thus, the circumferential ridge of the mote of the shuttle lid is perpendicularly positioned relative to the upper wall edges of the shuttle member when sealed.

The multiple configurations of the shuttle member comprise a first configuration wherein the shuttle member is collapsed to a flat state, the shuttle member fitting closely with the shuttle member lid to provide a unified lid for the insulated double-wall-construction base member, while preserving space for use of the removable divider. The shuttle member may also preferably fit closely with a top of the removable divider in order to prevent mixing of otherwise divided food items being held within the insulated double-wall-construction base member.

In a second configuration of this preferred first embodiment and aspect of the disclosure, the shuttle member is adapted for being extended to substantially fill a volume of an inner concave shape of the insulated double-wall-construction base member, the shuttle member thus providing a washable bowl, the upper edges of the shuttle member fitting closely with the sealing groove at the inner portion of the shuttle member lid to seal any items within the shuttle member, such configuration involving the removal or laying down of the removable divider. In another embodiment, the upper edges of the shuttle member fit closely with the sealing ridge of the shuttle member lid to seal any items within the shuttle member.

In another, third, configuration, the shuttle member is adapted to be extended to any of multiple volume shapes of the shuttle member outside of the insulated double-wall-construction base member, the shuttle member thus providing a means of storing food and other items in a location separate from the insulated double-wall-construction base member. The shuttle member is adapted for storage such as within a refrigerator, or for heating food items in a microwave oven within the shuttle member. The shuttle member lid also is available to seal the shuttle member when the shuttle member is outside of the insulated double-wall-construction base member. As an example, the shuttle member may be used to store food in a refrigerator without the added bulk of the insulated double-wall-construction base member, and the food may be heated in the shuttle member directly without the need to transfer the food to a separate cooking dish, reducing the need for energy and water to be used for cleaning additional cookware.

In accordance with another aspect and embodiment of the disclosure, there also may be provided a rigid container lid, adapted for engaging and attaching to the insulated double-wall-construction base member to provide convenient carrying and protection of the shuttle member within the insulated double-wall-construction base member. The rigid container lid is adapted to engage the smooth upper rim of the insulated double-wall-construction base member (or alternatively an extended rim of the shuttle lid when the shuttle and/or lid is retained in the base member) in such a manner as to secure the shuttle member and the shuttle member lid within the insulated double-wall-construction base member when combined. Optionally, the rigid container lid may extend beyond the smooth upper rim of the insulated double-wall-construction base member to shield an exposed edge of the shuttle member lid from dirt or other contaminants. In a preferred embodiment, the rigid container lid may have a dome shape and have a plurality of hooks along a periphery of the rigid container lid. The rigid container lid may be preferably made of thermoplastic, though any other material known in the art may be used.

In accordance with another aspect and embodiment of the disclosure, there also may be provided a utensil tray adapted for the holding of reusable utensils and other meal-related items within a space of the rigid container lid and above the shuttle member lid. In another embodiment, the utensil tray may have an outer peripheral rim, the outer peripheral rim defining a plurality of openings along the outer peripheral rim. The utensil tray may preferably be made of thermoplastic, but any other known material in the art that is suitable to the purpose of the disclosed device may be used. The utensil tray may be optionally magnetic. An optional utensil strap may be provided which may be made of thermoplastic, food-grade silicone, or any other suitable material known in the art.

In accordance with another aspect and embodiment of the disclosure, there also may be provided a gasket, shaped on an underside of the utensil tray to nest on top of the shuttle member lid when the shuttle member lid is retained within the modular, insulated combination meal and to-go box. An upper side of the shuttle member lid may be shaped to fit adjacent and under a bottom of the gasket. The gasket further may have a plurality of knobs adapted for insertion and retention within the plurality of openings defined on the outer peripheral rim of the utensil tray to form a sealed gasket-tray unit for sealing with the periphery of the rigid container lid, wherein sealed combination of the rigid container lid and the sealed gasket-tray unit form a double-walled construction unit that further insulates when combined with the insulated double-wall-construction base member using the at least one latch member. The gasket may be preferably made of food-grade silicone, though any other suitable material known in the art may be used without departing from the invention as claimed. Utensils may be adapted for being retained on the utensil tray between the rigid container lid and the sealed gasket-tray unit.

In accordance with another aspect and embodiment of the disclosure, there also may be at least one latch member attached to the insulated double-wall-construction base member. The at least one latch member is adapted for securing the rigid container lid to the insulated double-wall-construction base member. In an embodiment, the at least one latch member preferably comprises a plurality of (or preferably two) latch members. Each of the plurality of latch members may align and correspond with one of said plurality of hooks. Each of the plurality of latch members is adapted for sliding relative to the insulated double-wall-construction base member and the rigid container lid such that an engagement portion of each of said plurality of latch members engages with a corresponding one of the plurality of hooks.

In an embodiment, each of the plurality of latch members preferably further comprises a rail body, at least one bar on a top of the rail body, and a pivot shaft that is longer than a length of the rail body, a sliding latch that attaches to the at least one bar of the rail body, wherein the sliding latch is capable of sliding sideways on the at least one bar of the rail body to release or combine with one of the hooks of the plurality of hooks of the rigid container lid to seal the rigid container lid to the insulated double-wall-construction base member. In this embodiment, each of the plurality of latch members further comprises a hinged partial loop, shaped to cover at least a portion of the rail body, comprising a top portion that attaches to the pivot shaft passing through the rail body and enabling the hinged partial loop to rotate upwards on the pivot shaft to allow attachment to a carrying means such as a carry strap or a carabiner. Each of the plurality of latch members further comprises at least one attachment means that attaches the rail body to the insulated double-wall-construction base container. In an embodiment, the at least one attachment means of the plurality of latch members may be at least one bolt that attaches to the insulated double-wall-construction base member by at least one weld nut. The at least one latch member may be two latch members. The at least one latch member may be made of thermoplastic, but any other suitable material known in the art may be used.

Additionally, in accordance with another aspect and embodiment of the disclosure, there is provided a surface, preferably a flat surface, on at least one of the insulated double-wall-construction base shuttle member and the rigid container lid, adapted for printing of indicia thereon for marketing and branding, to allow providers, such as grocery retail outlets, restaurants, or leisure activity retailers, to promote their name, either alone or along with an environmentally friendly message, together with use of this environmentally friendly and multi-functional food container and to-go box. In an embodiment, there may also be a flat surface on the shuttle member lid or the base member of the insulated double-wall-construction base member (in a case where the base member doesn't have the finger grip indentations of a preferred embodiment). A sticker of indicia may be used instead of printing.

In accordance with an aspect and embodiment of the device, the modular, insulated combination meal and to-go box may be further adapted for easy cleaning and re-use for supporting ecological best practices and avoiding use of single-use disposable containers.

In accordance with another aspect and embodiment of the disclosure, the insulated double-wall-construction base member may further preferably comprise a shaped bottom surface with finger-grip ridges adapted for more comfortable and secure holding of the insulated double-wall-construction base member with the rigid container lid when combined.

BRIEF DESCRIPTIONS OF DRAWINGS

Figure 1:
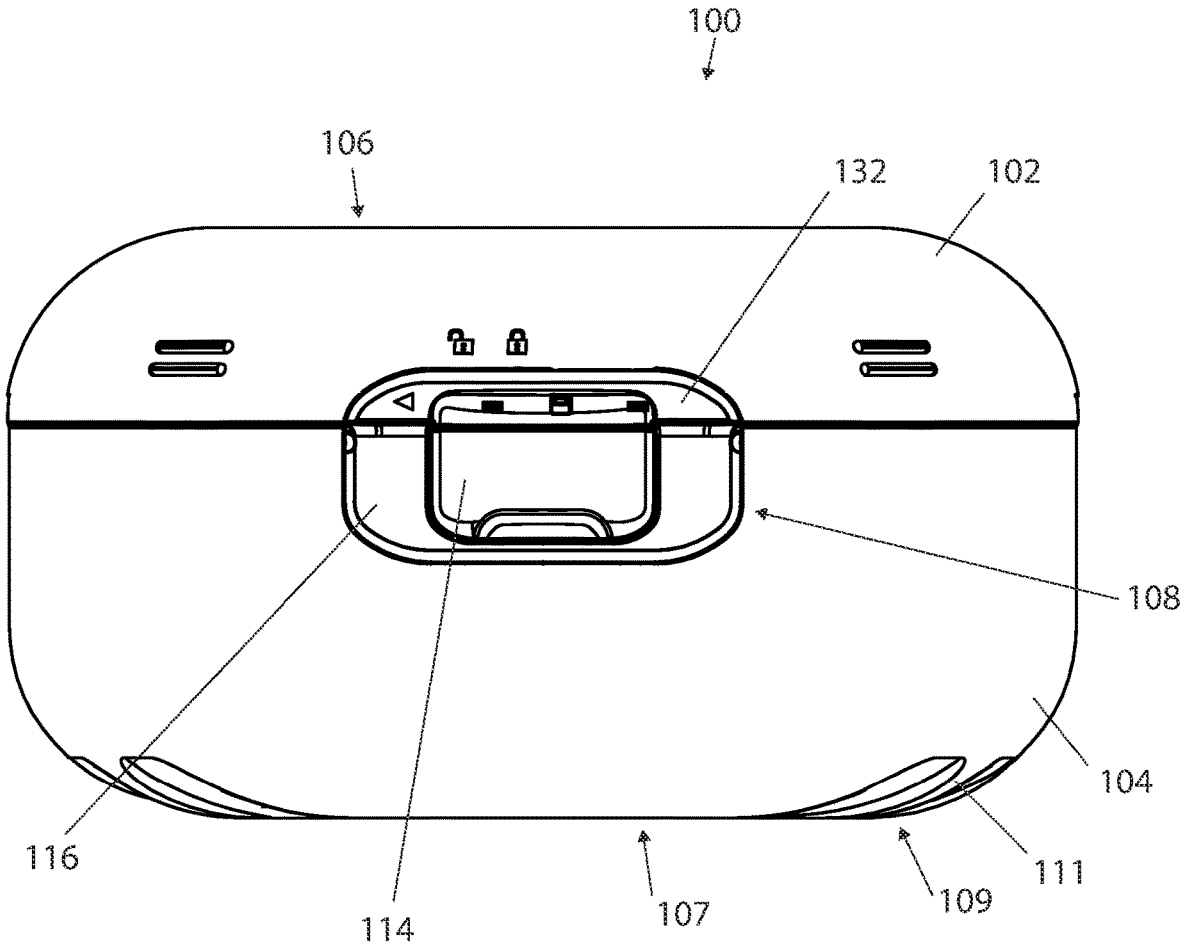
FIG. 1 is a front view of an embodiment of a modular, insulated combination meal and to-go box in accordance with one or more aspects of the disclosure, showing a rigid container lid and an insulated double-wall-construction base member combined with two latch members (only one latch member visible).
Figure 2:
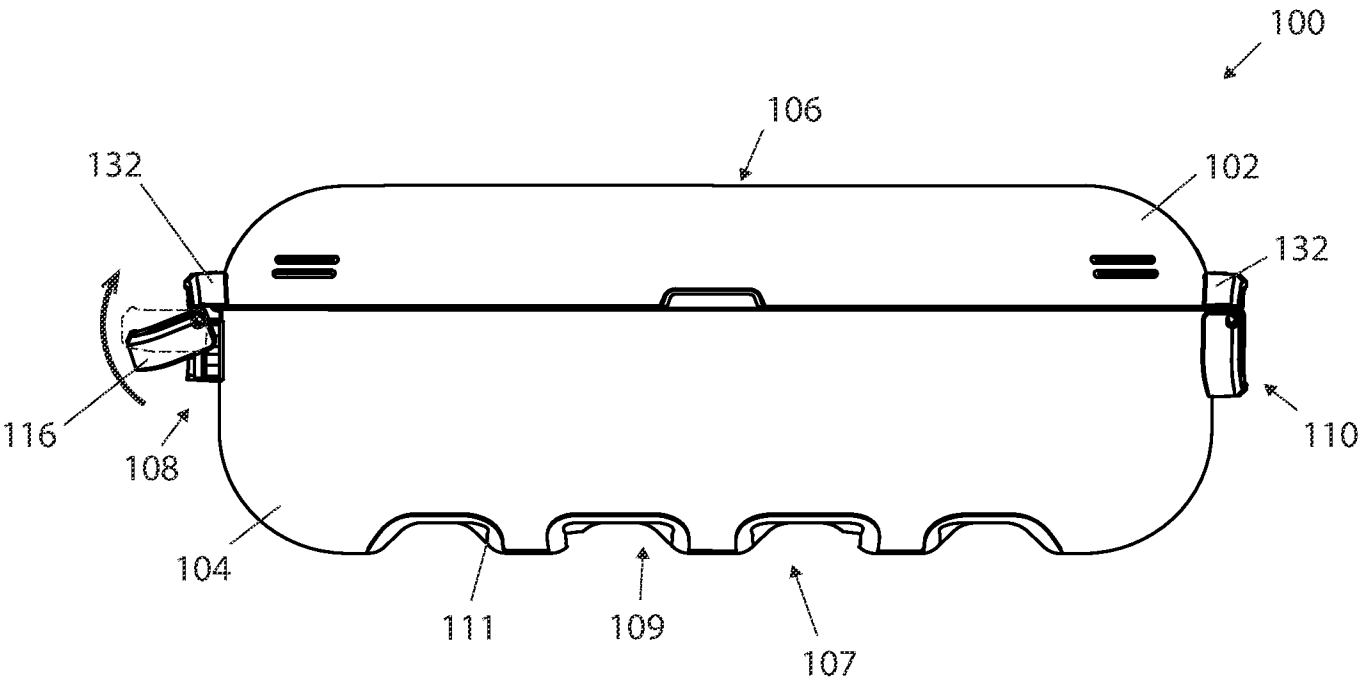
FIG. 2 is a side view of an embodiment of the modular, insulated combination meal and to-go box in FIG. 1, showing the rigid container lid and the insulated double-wall-construction base member combined with two latch members. A hinged partial loop of one of the latch members is shown rotated upwards in two alternate positions (one position dotted).
Figure 3:
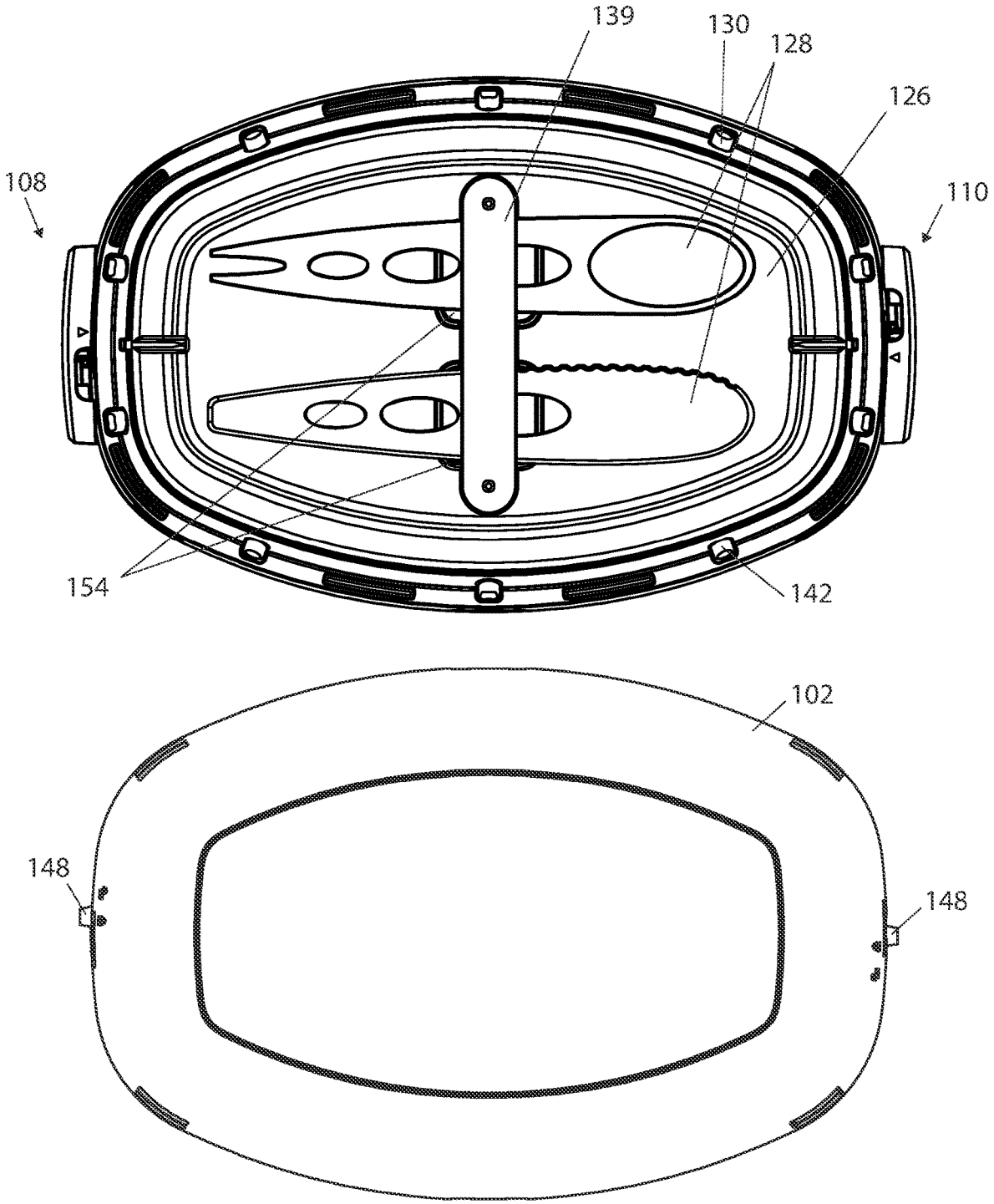

FIG. 3 is a top view of an embodiment of the modular, insulated combination meal and to-go box of FIGS. 1-2, with the rigid container lid removed, showing utensils, a utensil strap, a utensil tray, and a gasket contained within the insulated double-wall-construction base member with two latch members. The rigid container lid may be clear to allow seeing of the utensils and any other contents within the lid.

Figure 4:
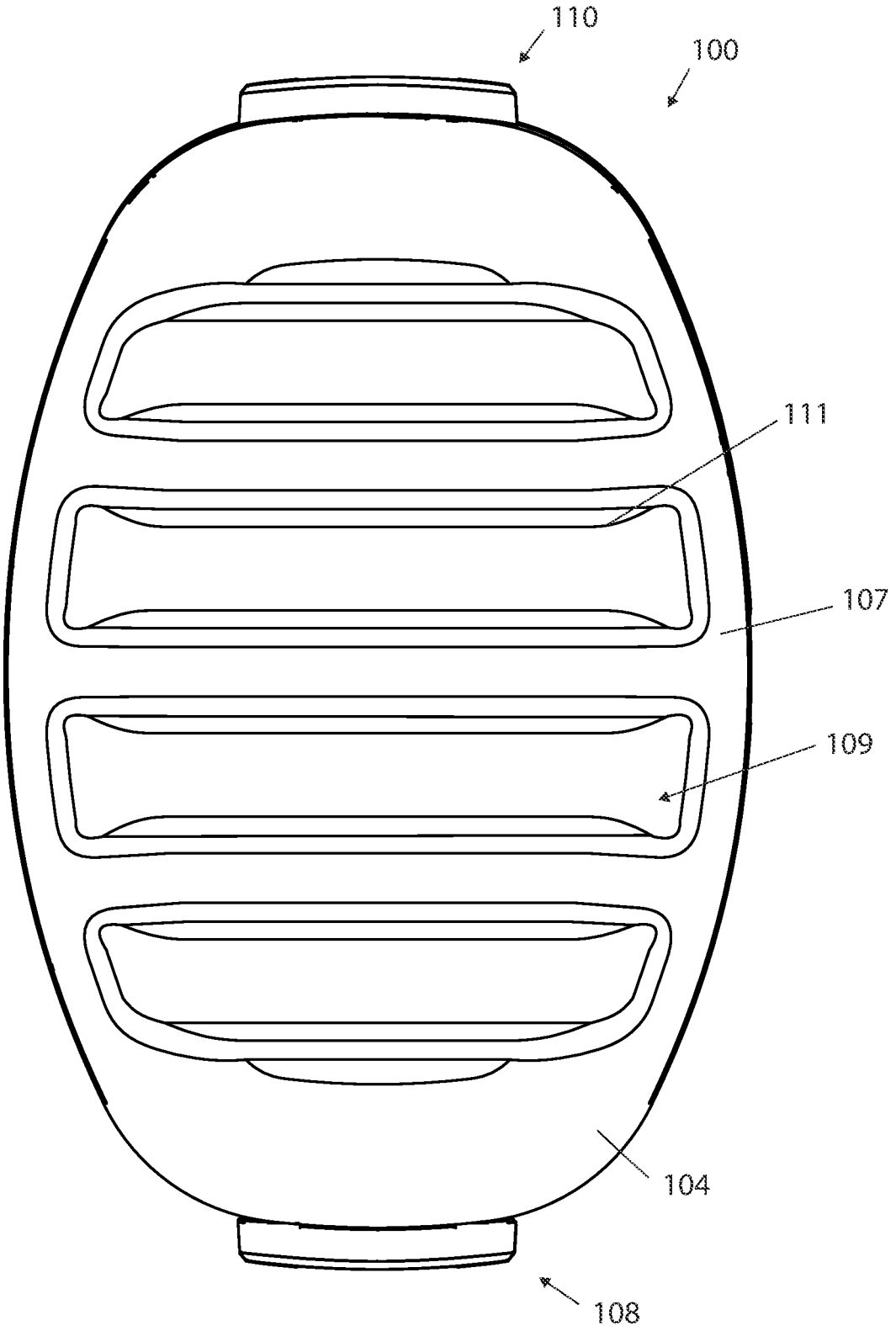

FIG. 4 is a bottom view of an embodiment of the modular, insulated combination meal and to-go box in FIGS. 1-3, showing the insulated double-wall-construction base member with two latch members attached. The preferable shaped bottom surface with finger-grip ridges on the outer base of the insulated double-wall-construction base member are shown.

Figure 5:
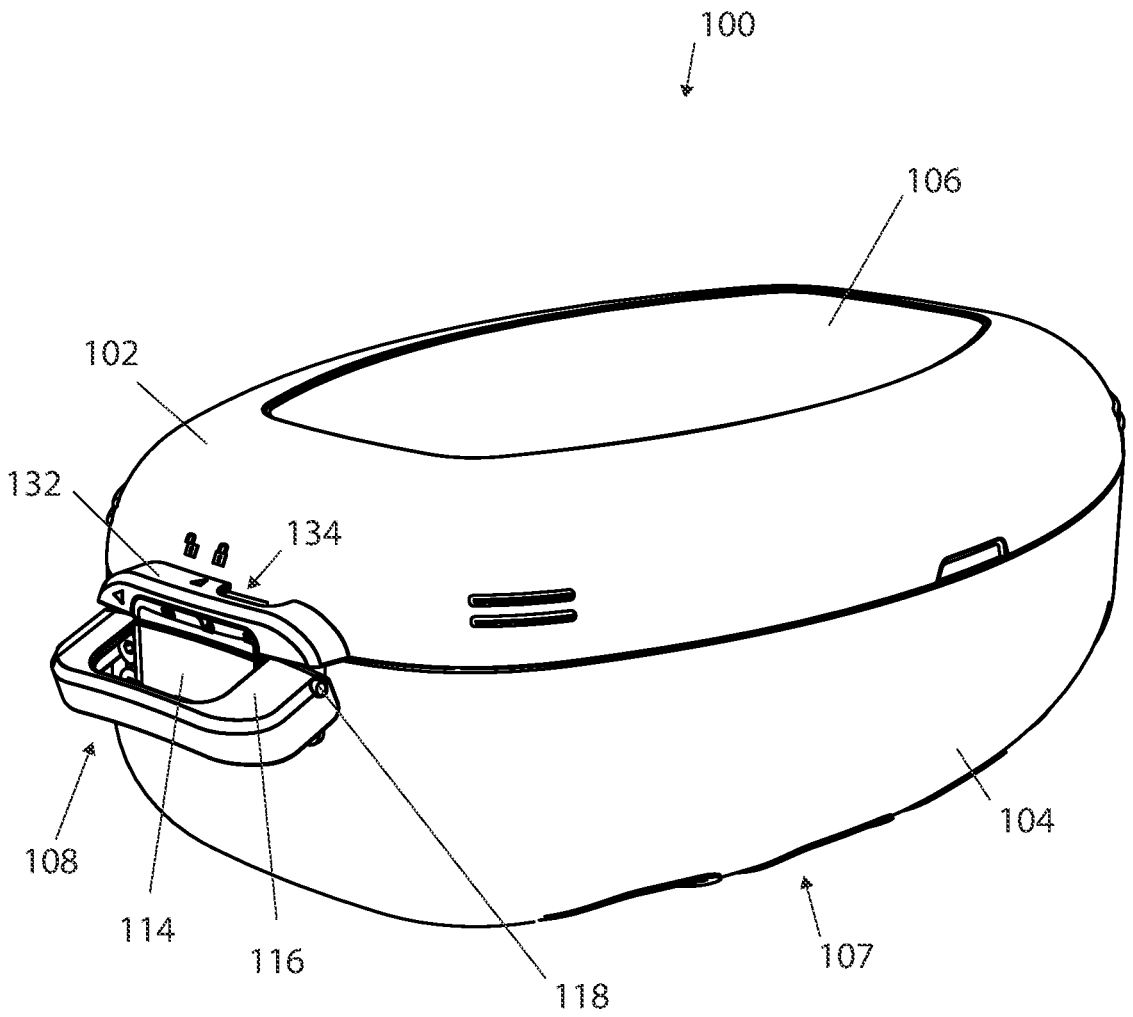

FIG. 5 is a perspective view of an embodiment of the modular, insulated combination meal and to-go box in FIGS. 1-4, showing the rigid container lid and the insulated double-wall-construction base member with the two latch members (only one latch member visible and in a locked position), showing a hinged partial loop of the latch member rotated upwards to allow attachment to a carrying strap or carabiner.

Figure 6:
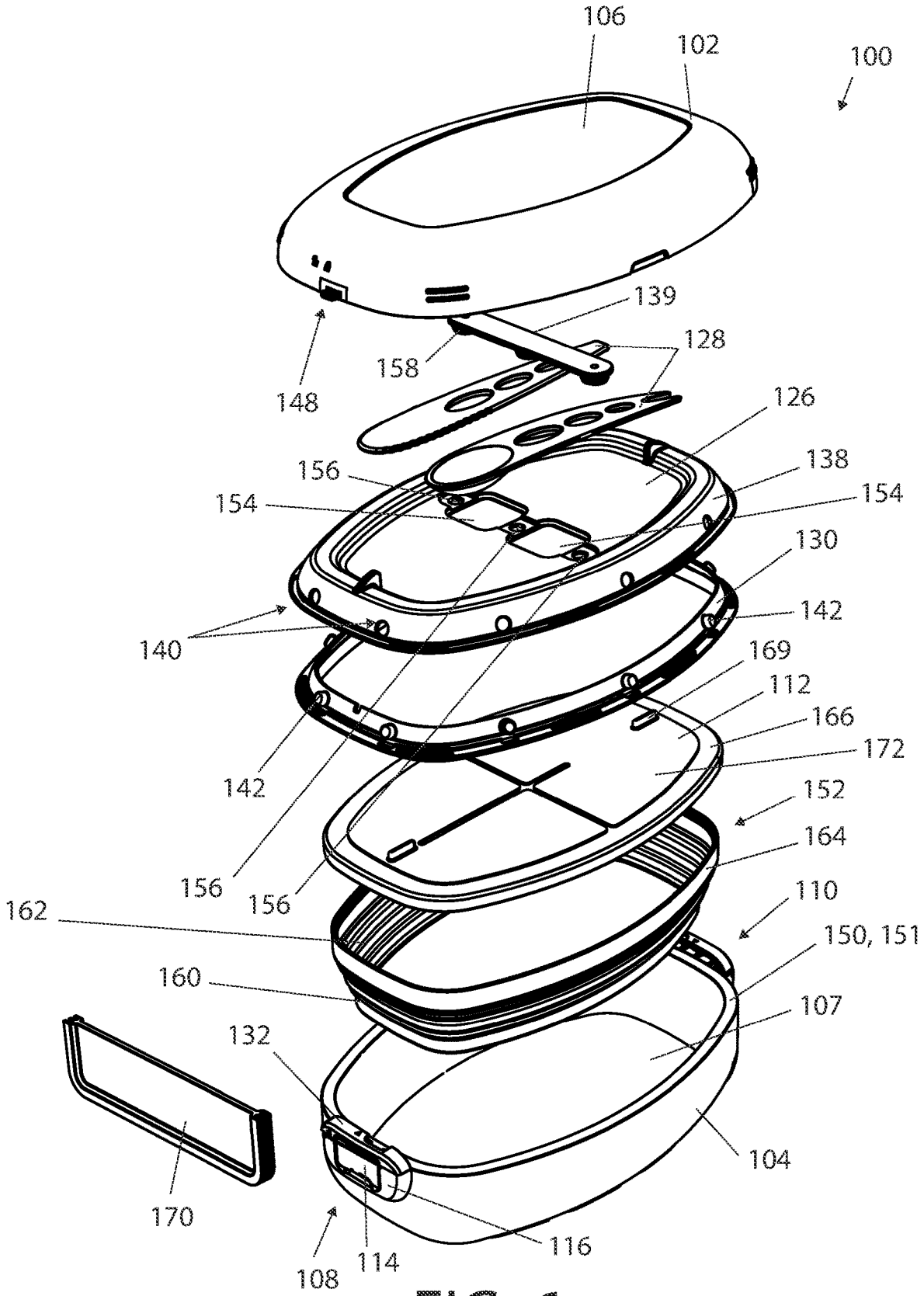

FIG. 6 is an exploded perspective view of an embodiment of the modular, insulated combination meal and to-go box in FIGS. 1-5, showing the rigid container lid, a utensil strap, utensils, a utensil tray, a gasket, a shuttle member lid, a shuttle member, and the insulated double-wall-construction base member attached to two latch members. A removable divider is shown to the side, next to the insulated double-wall-construction base member.

Figure 7:
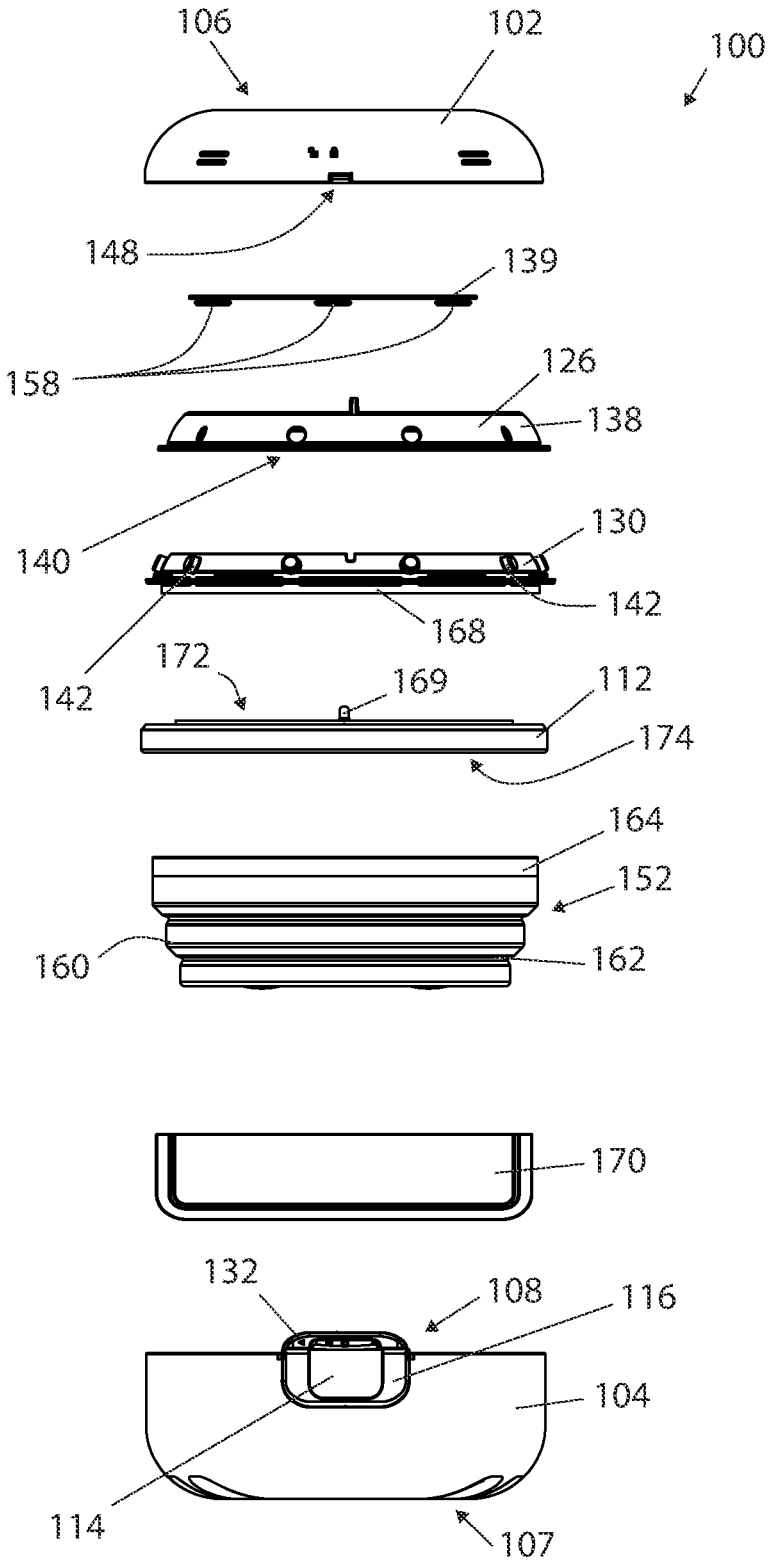

FIG. 7 is an exploded front view of an embodiment of the modular, insulated combination meal and to-go box in FIGS. 1-6, showing the rigid container lid, the utensil strap, the utensil tray, the gasket, the shuttle member lid, the shuttle member, the removable divider and the insulated double-wall-construction base member attached to two latch members (only one latch member is visible). Utensils are not shown.

Figure 8:
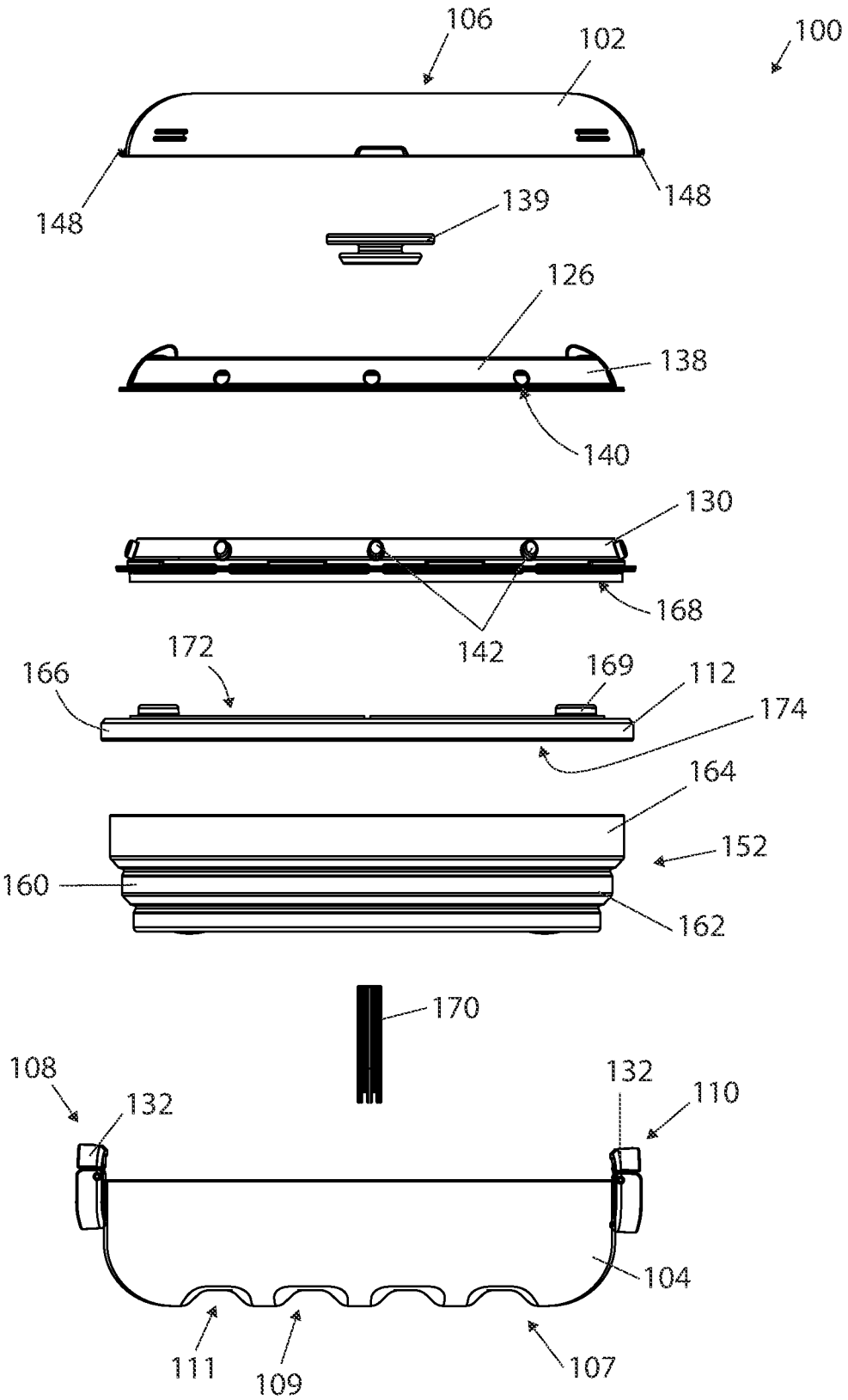

FIG. 8 is an exploded side view of an embodiment of the modular, insulated combination meal and to-go box in FIGS. 1-7, showing the rigid container lid, the utensil strap, the utensil tray, the gasket, the shuttle member lid, the shuttle member, the removable divider and the insulated double-wall-construction base member attached to two latch members. Utensils are not shown.

Figure 9:
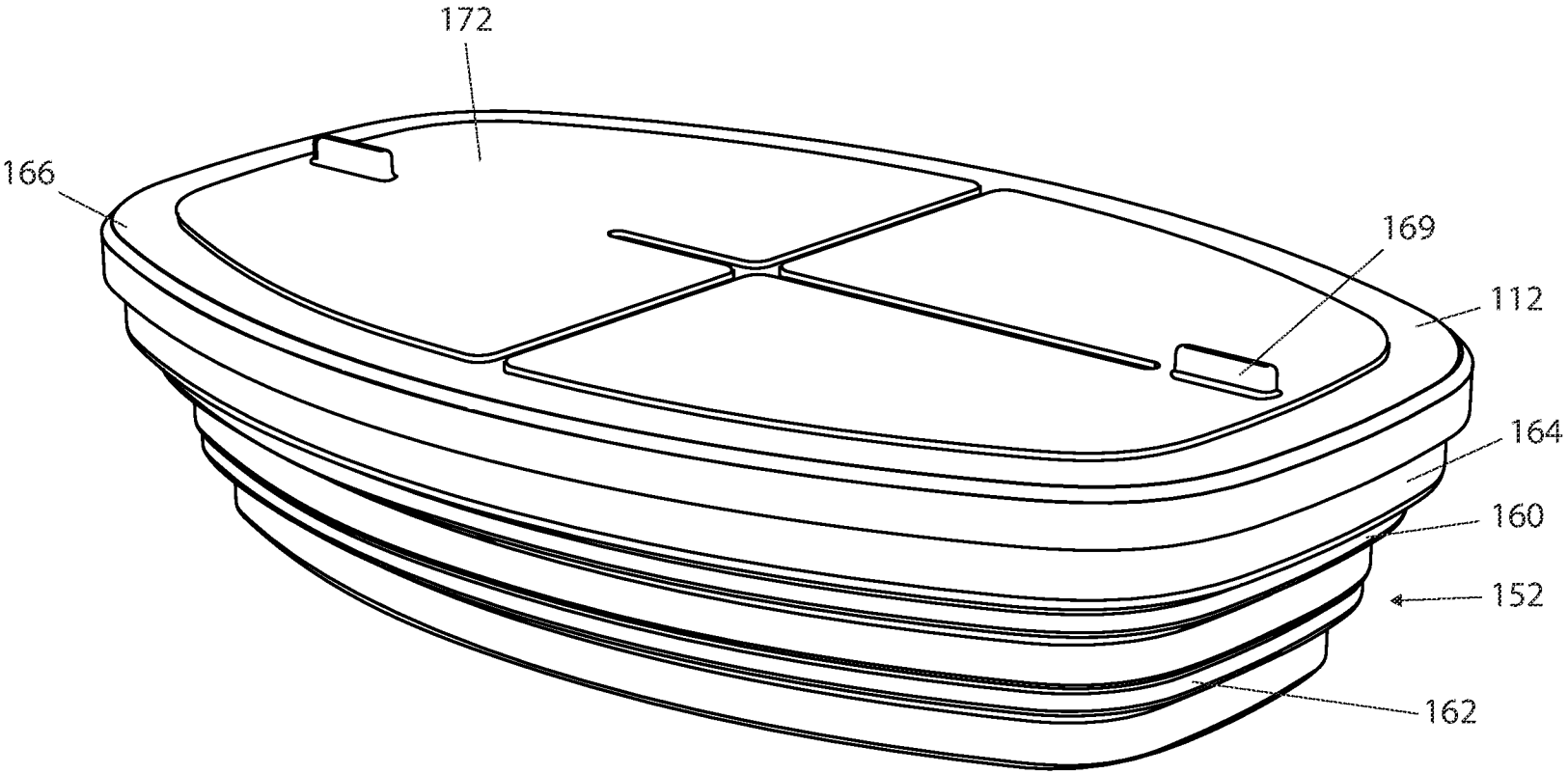

FIG. 9 is a perspective view of an embodiment of the shuttle member lid and the shuttle member of the modular, insulated combination meal and to-go box in FIGS. 1-8.

Figure 10:
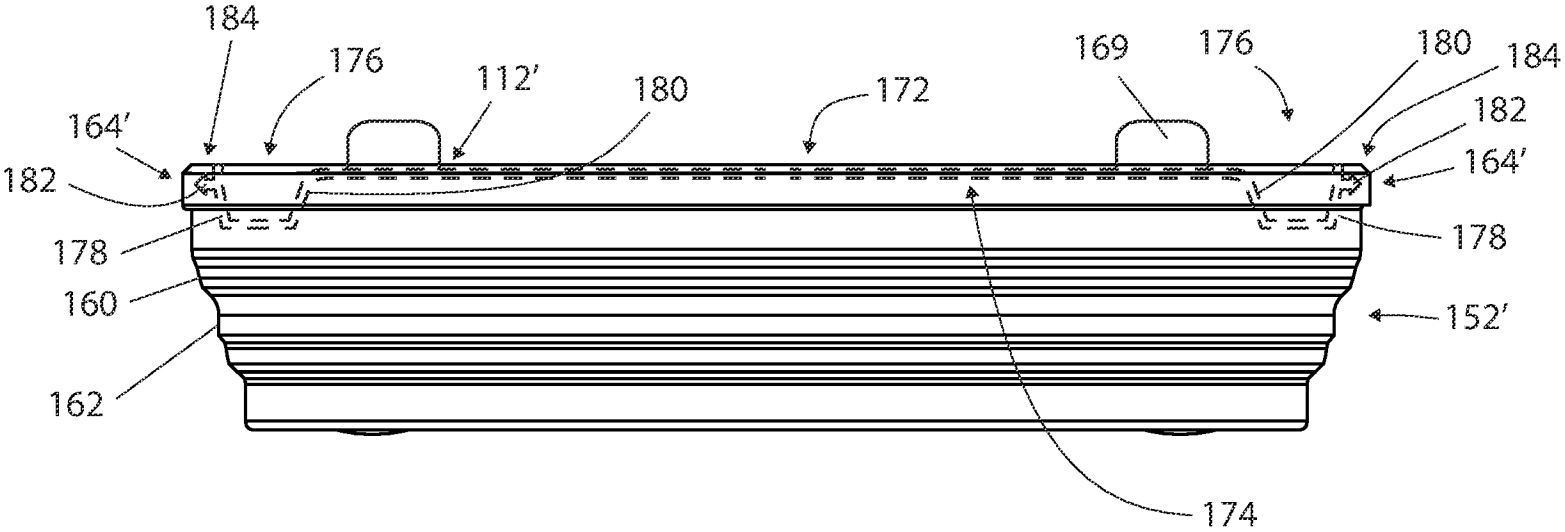

FIG. 10 is a side view of another embodiment of the shuttle member lid and the shuttle member of the modular, insulated combination meal and to-go box in FIGS. 1-8. The shuttle member lid shows a circumferential mote and ridge, a sealing circumferential ridge and circumferential groove, and a top side of the lid in dotted lines inside the shuttle member.

Figure 11:
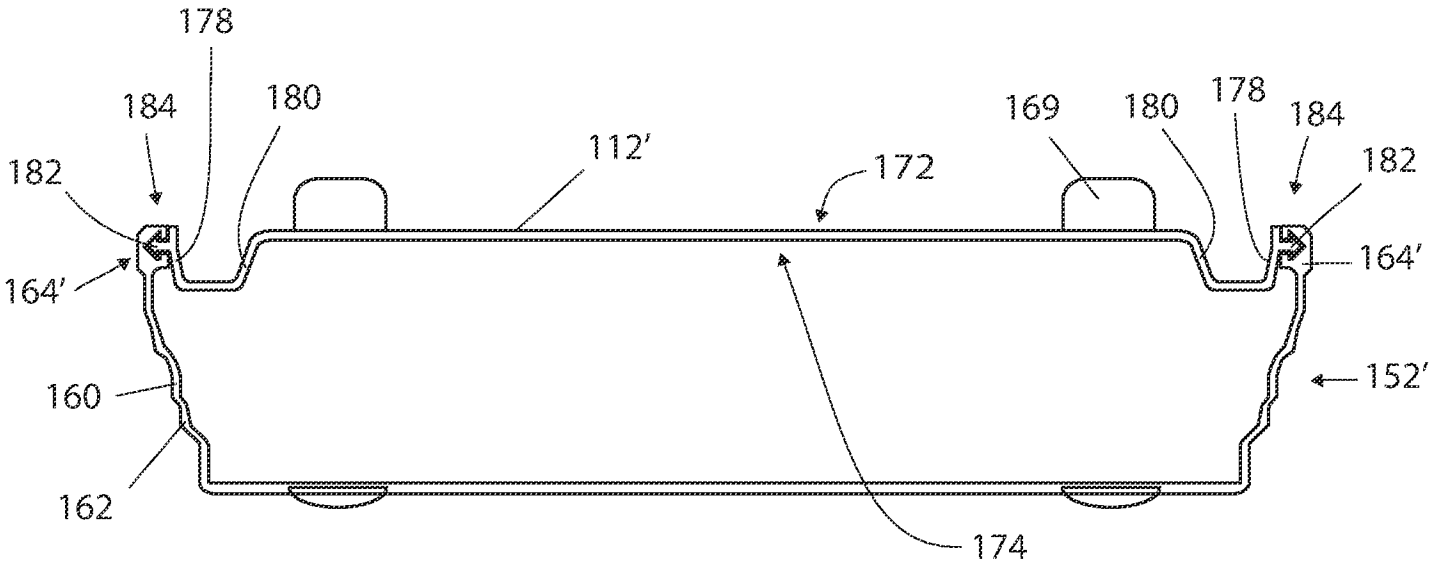

FIG. 11 is a sectional view of the shuttle member lid and the shuttle member of the modular, insulated combination meal and to-go box in FIG. 10. The sealing ridge (appearing as outwardly pointing arrows—though other suitably shaped ridges may be employed) of the shuttle member lid makes perpendicular contact with the sealing groove of the upper edges of the shuttle member. The circumferential groove and ridge prevent compression of the shuttle member while opening or closing the shuttle member lid.

Figure 12:
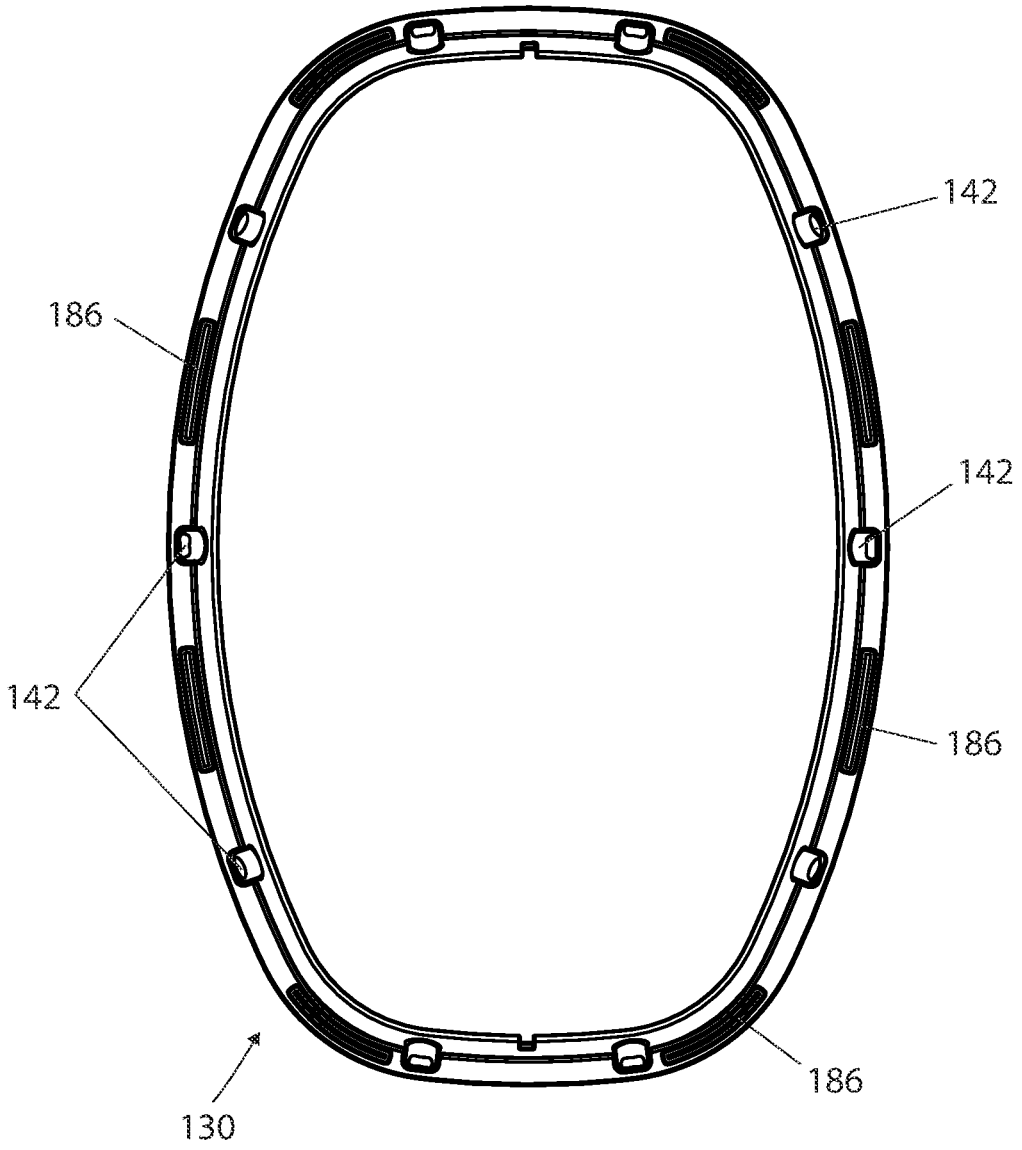

FIG. 12 is a top view of an embodiment of the gasket of the modular, insulated combination meal and to-go box in FIGS. 1-9. A plurality of knobs can be seen.

Figure 13:
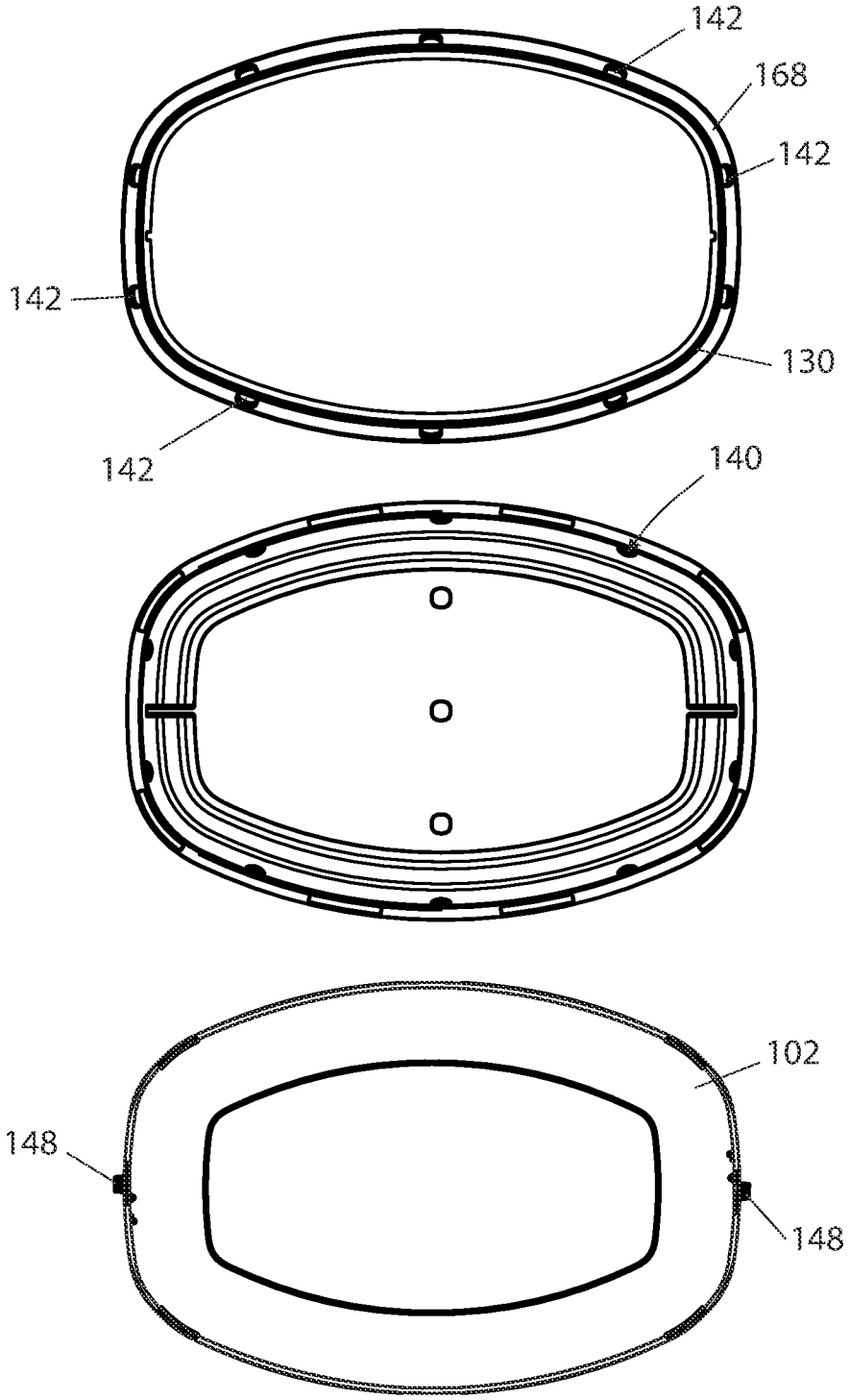

FIG. 13 is bottom views of an embodiment of the rigid container lid (the lowermost device), the gasket (the uppermost device), and the utensil tray of the modular, insulated combination meal and to-go box in FIGS. 1-8, and FIG. 12. The shuttle member lid, the utensil tray, and the gasket can be combined to form a double-walled construction unit to insulate food items when combined and sealed with the insulated double-wall-construction base member using at least one latch member.

Figure 14:
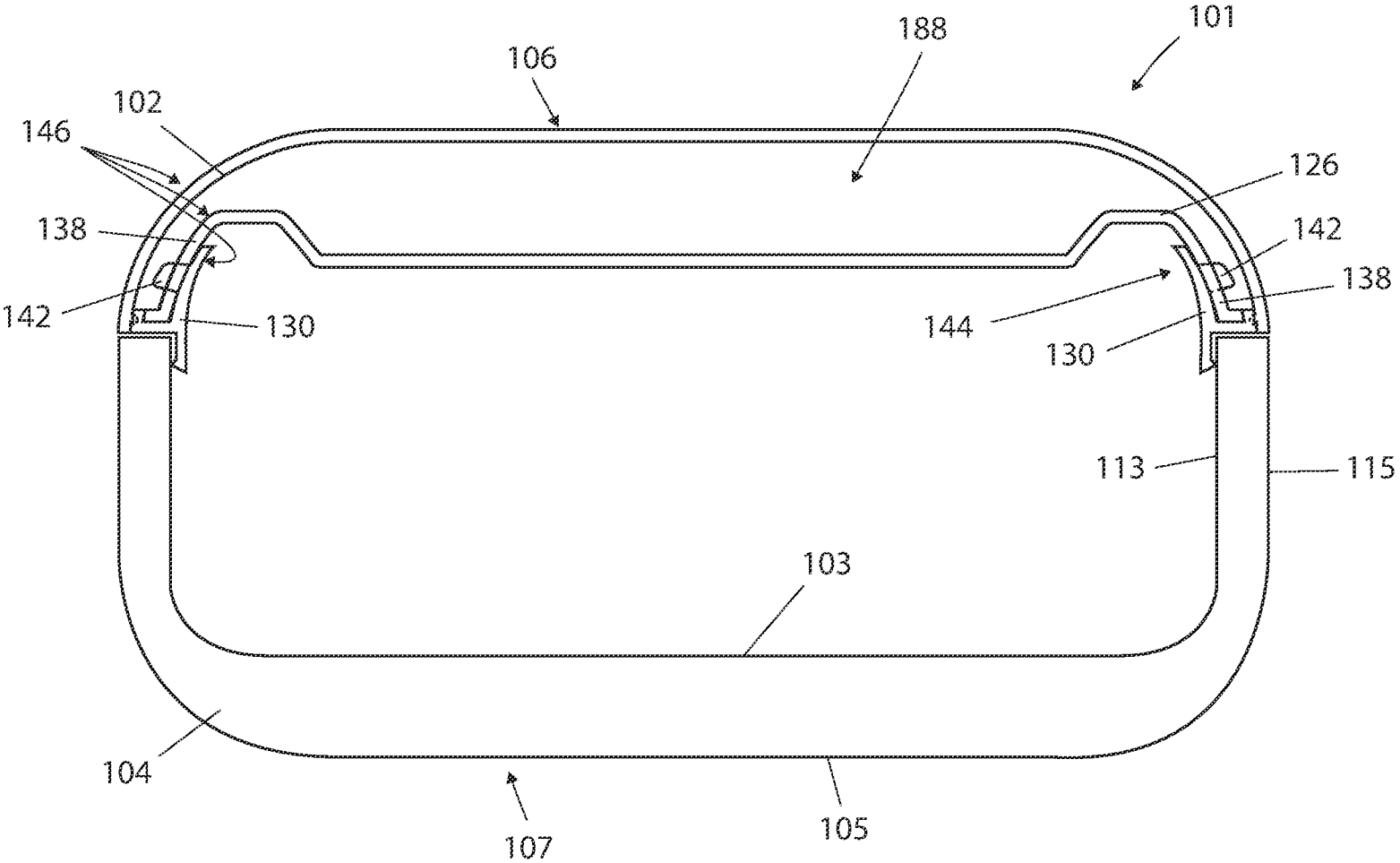

FIG. 14 is a sectional view of the double-walled construction unit and the insulated double-wall-construction base member of the modular, insulated combination meal and to-go box in FIGS. 1-8, 12-13. The double-walled construction unit is formed by the combination of the utensil tray, the gasket, and the rigid container lid.

Figure 15:
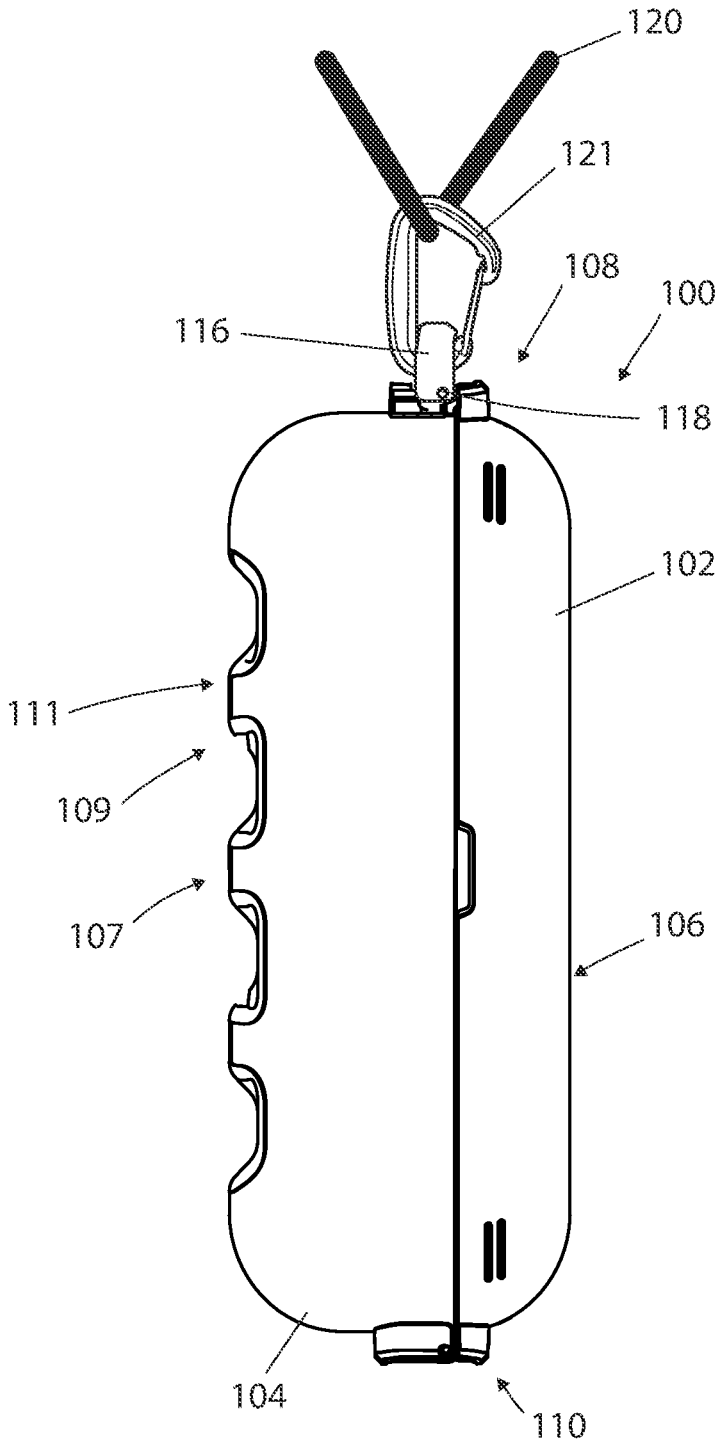

FIG. 15 is a side view of an embodiment of the modular, insulated combination meal and to-go box in FIGS. 1-14, showing the rigid container lid and the insulated double-wall-construction base member combined with two latch members. A hinged partial loop of one of the latch members is shown rotated upwards to allow for a carabiner to hook onto the hinged partial loop, allowing for easy carriage of the insulated combination meal and to-go box.

Figure 16:
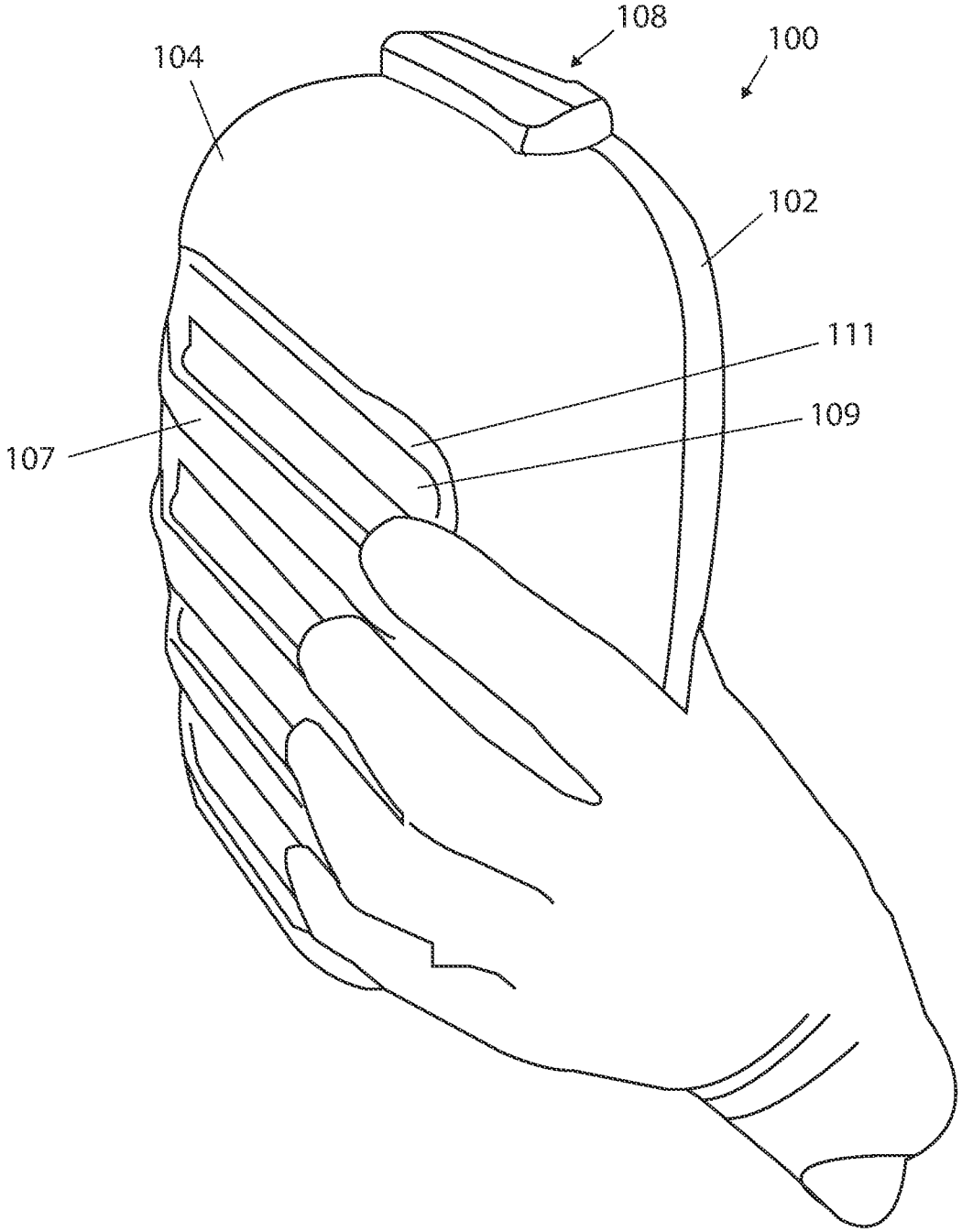

FIG. 16 is a side perspective view of an embodiment of the modular, insulated combination meal and to-go box in FIGS. 1-15, showing the rigid container lid and the insulated double-wall-construction base member with finger-grip ridges combined with two latch members (only one latch member visible) being held by a hand.

Figure 17:
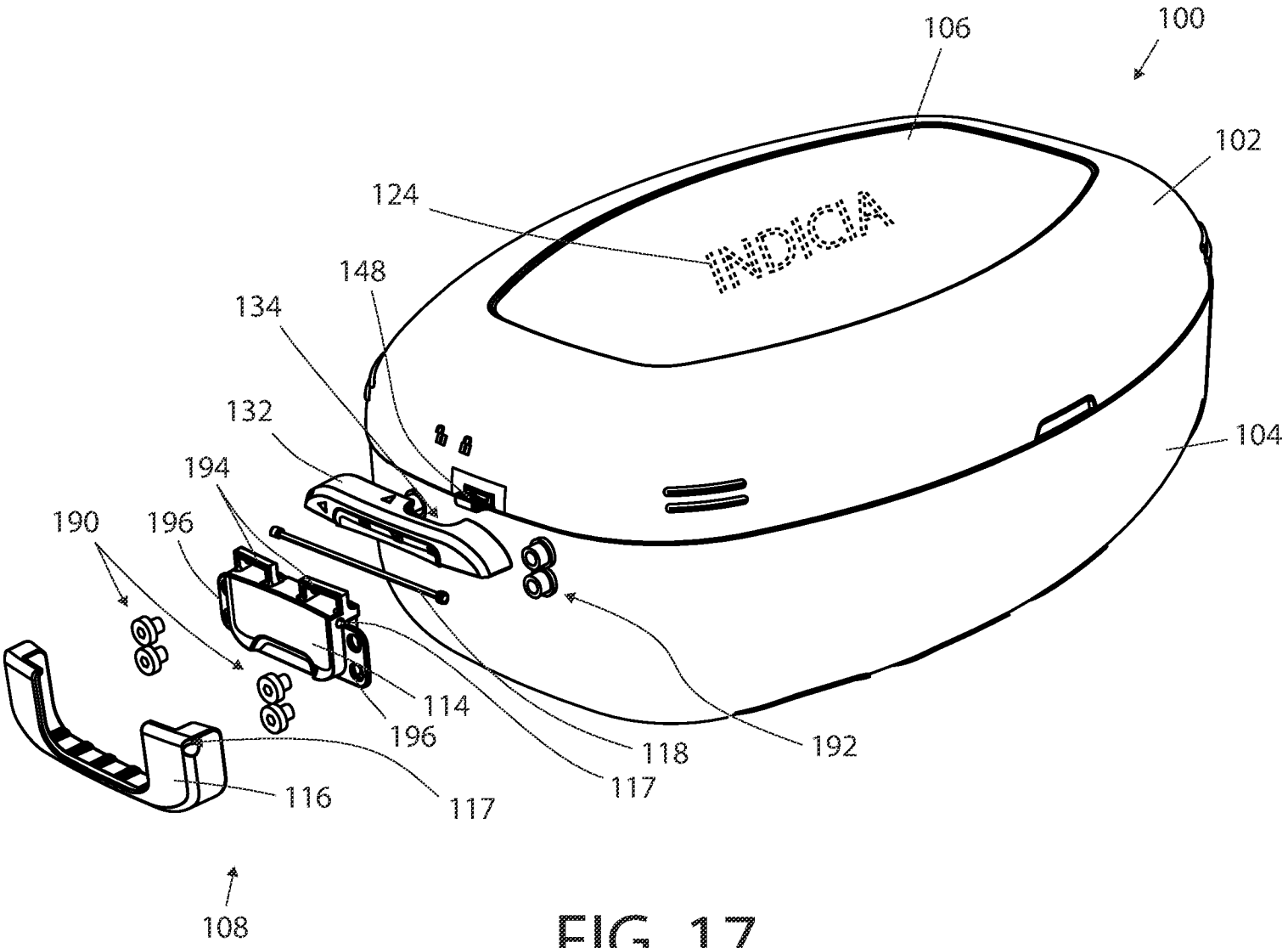

FIG. 17 is a perspective view of an embodiment of the modular, insulated combination meal and to-go box in FIG. 1-17, showing the rigid container lid and the insulated double-wall-construction base member combined with two latch members (only one latch visible), showing an exploded view of a latch member. The exploded latch member shows a rail body with two bars on the top, a pivot shaft, a sliding latch, a hinged partial loop, and four weld nuts. FIG. 17 also shows that indicia may be engraved or otherwise affixed on the rigid container lid.

Figure 18:
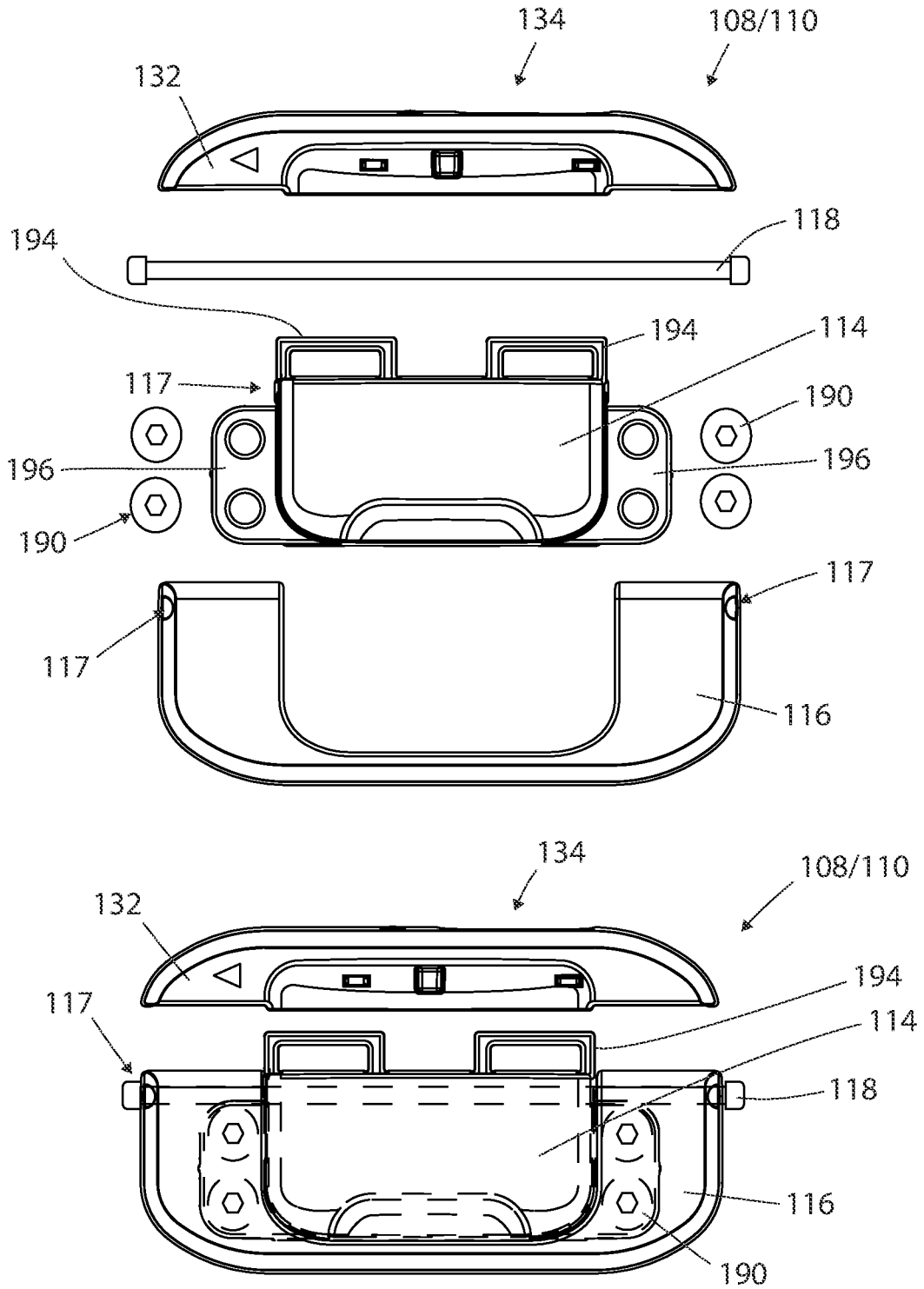

FIG. 18 includes exploded and partially assembled views of embodiments of the preferred latches of the modular, insulated combination meal and to-go box in FIGS. 1-17. The exploded latch member shows a rail body with two bars on the top, a pivot shaft, a sliding latch, a hinged partial loop, and four weld nuts. The partially assembled view shows how the components are combined to form a working latch.

Figure 19:
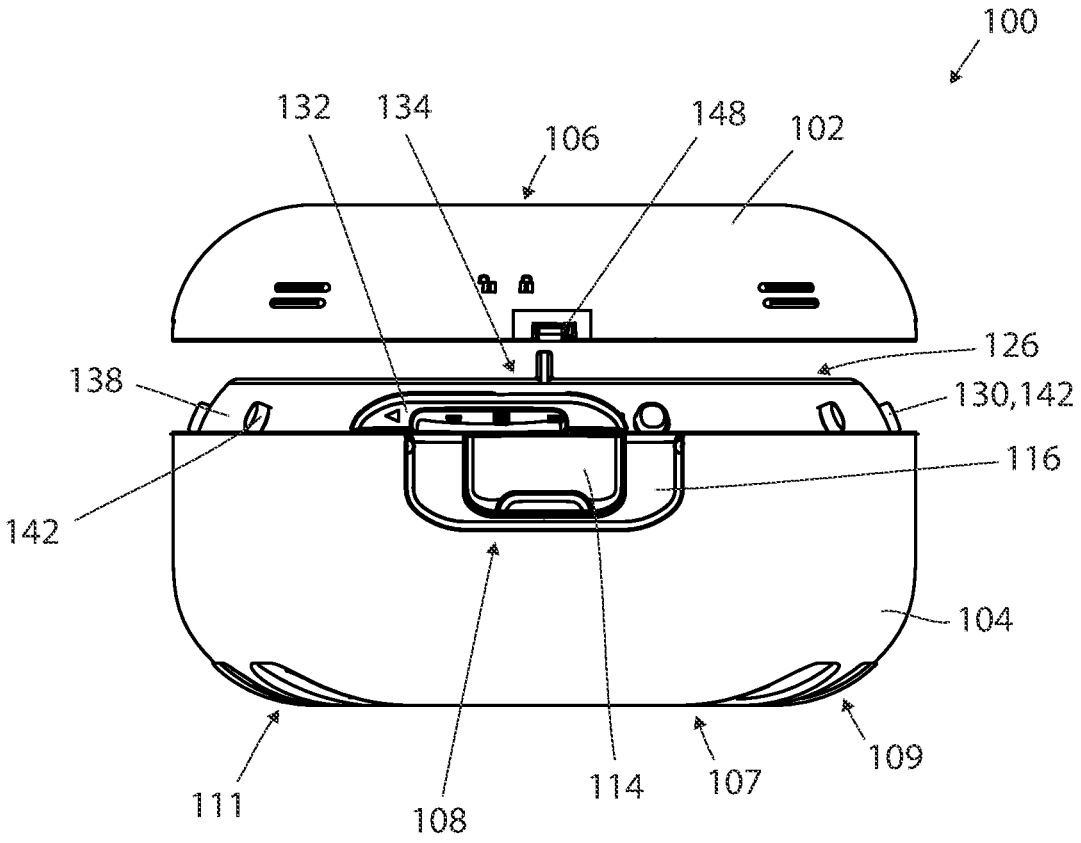

FIG. 19 is a front view of an embodiment of the modular, insulated combination meal and to-go box in FIG. 1-18, with a sliding latch slid to a side and the rigid container lid unlocked and lifted from the insulated double-wall-construction base member.

Figure 20:
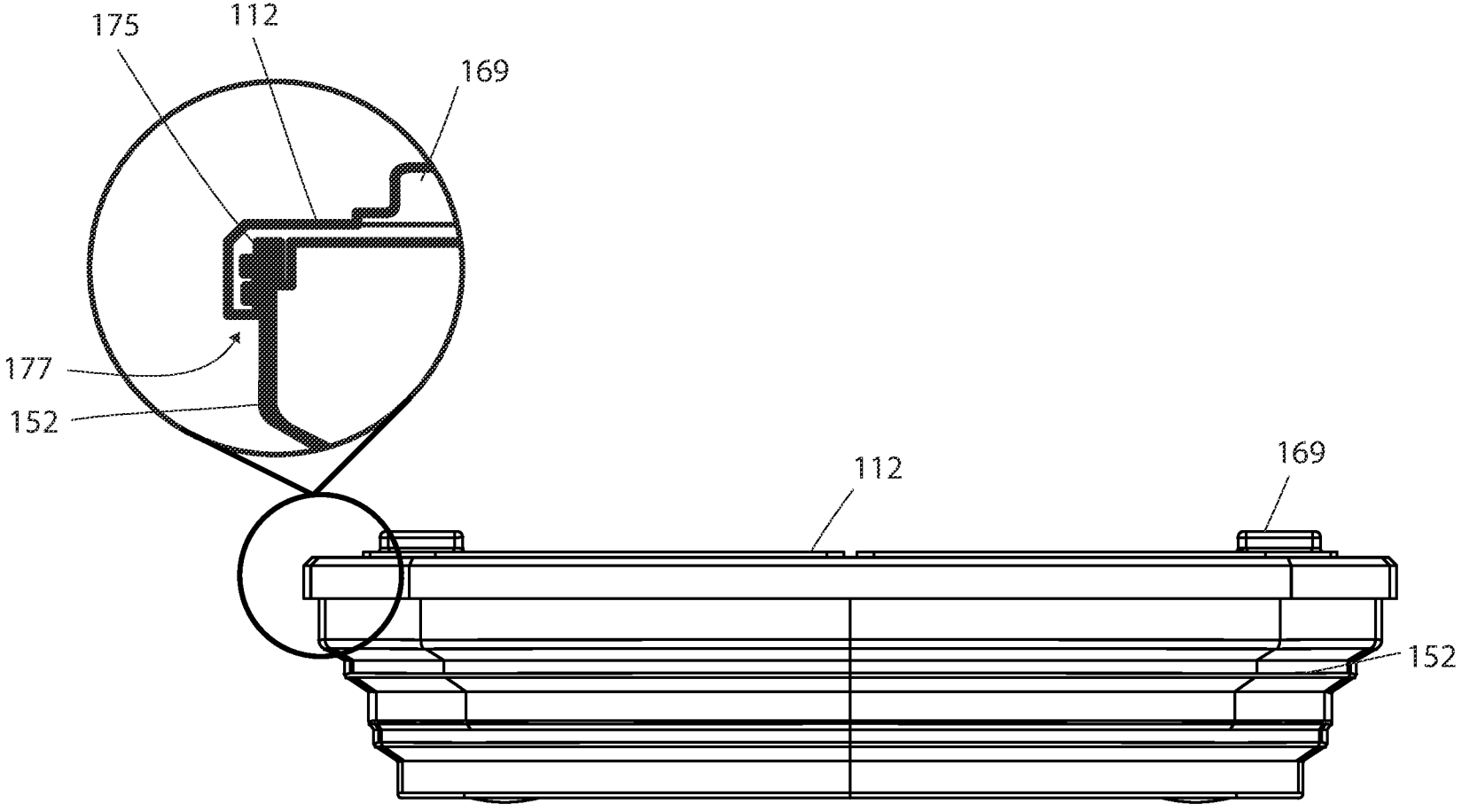

FIG. 20 is a side detailed view of an embodiment of a shuttle and shuttle lid combination showing one way that the shuttle lid may engage the shuttle wall.

Figure 21:
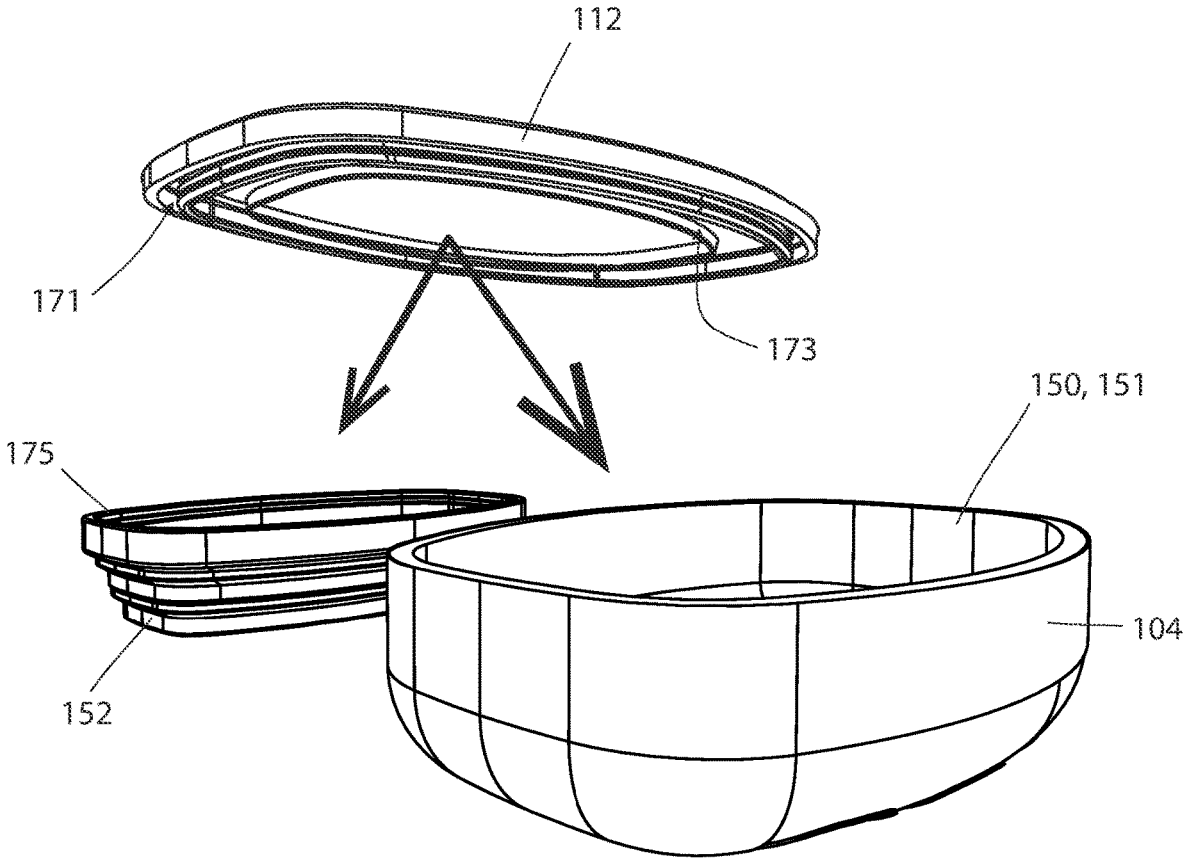

FIG. 21 is a perspective view of how the shuttle lid may be used in an embodiment to seal either, or both, the shuttle and the insulated double-wall-construction base member.

Figure 22:
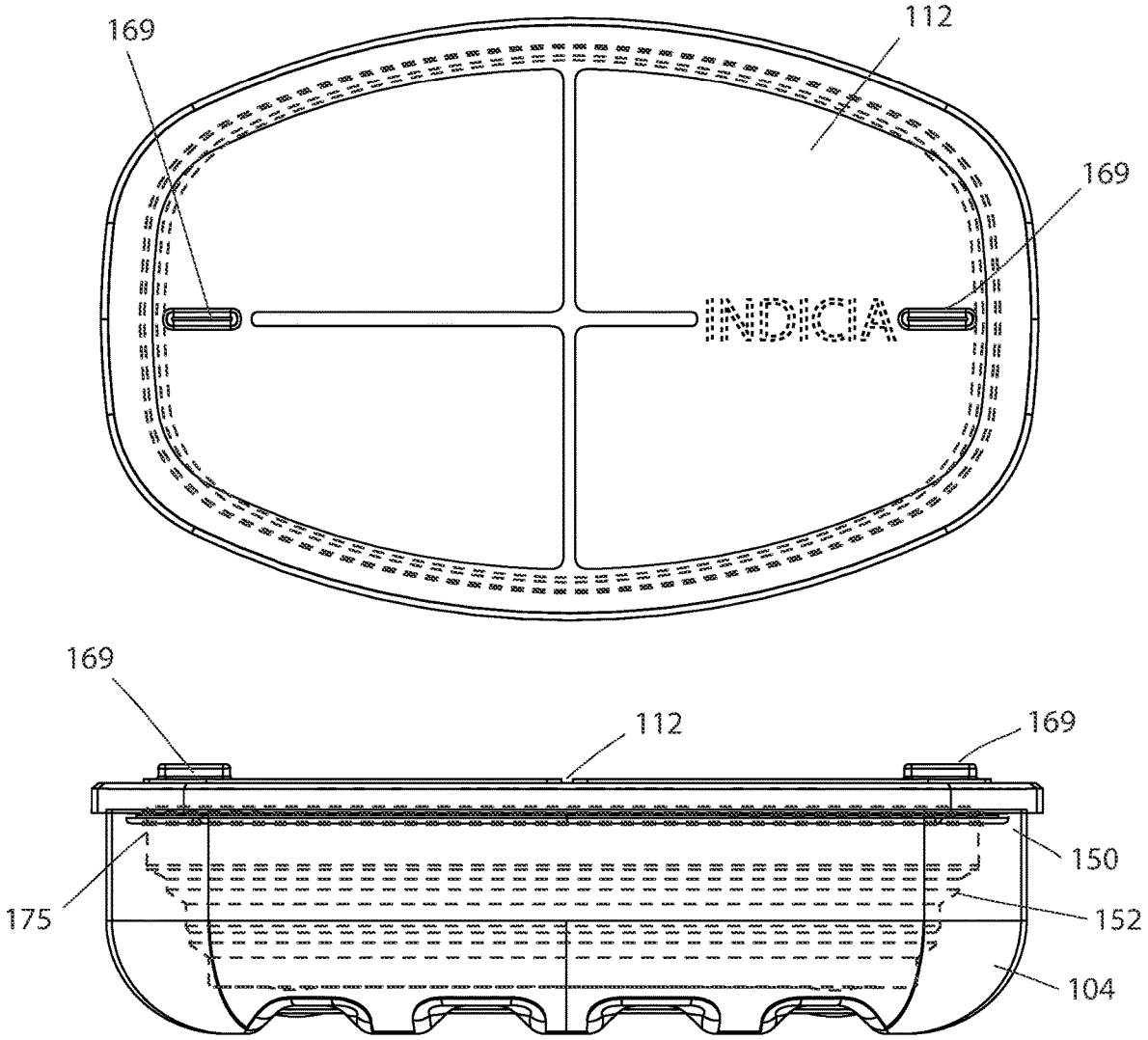

FIG. 22 is a combination top and side view of the shuttle lid (including hidden lines) and how in an embodiment it seals both the shuttle (shown in hidden lines) and the insulated double-wall-construction base member.

Figure 23:
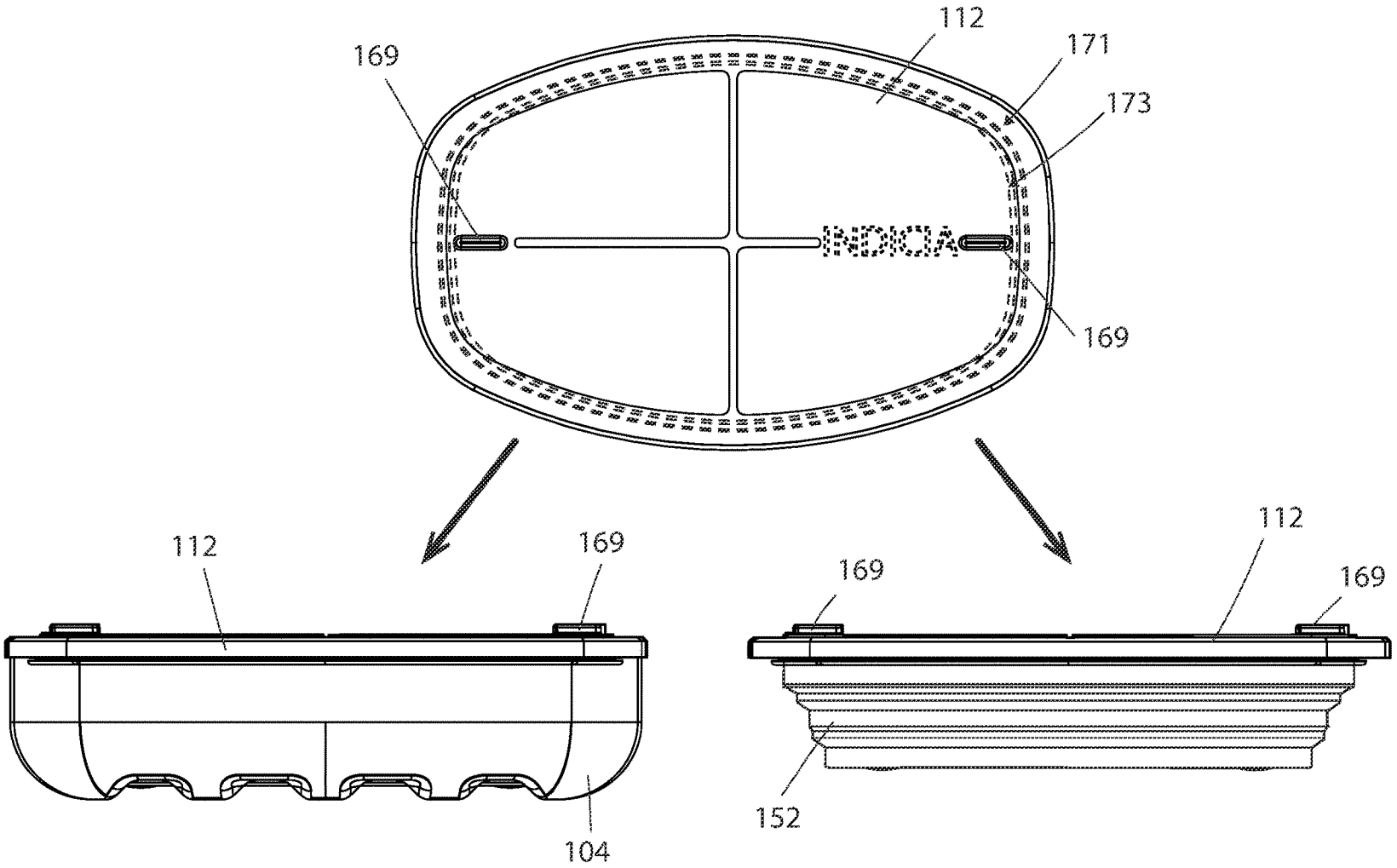

FIG. 23 is another combination top with side views of the shuttle lid and how it may be used to seal the shuttle and the insulated double-wall-construction base member, each independently.

DETAILED DESCRIPTION

The present disclosure provides various embodiments of a modular, insulated combination meal and to-go box adapted for facilitating ecologically responsible and reusable storage and transport of food and other items.

FIG. 1 shows a front view of an embodiment of a modular, insulated combination meal and to-go box 100 in accordance with one or more aspects of the disclosure. The modular, insulated combination meal and to-go box 100 of FIG. 1 is comprised externally of a rigid container lid 102 and an insulated double-wall-construction base member 104. The rigid container lid 102 in this embodiment is dome shaped and preferably with a flat surface 106 on its top. The rigid container lid 102 may be other shapes, such as box shaped. The rigid container lid 102 is preferably made of thermoplastic, but other materials known in the art, such as stainless-steel, may be used. The rigid container lid 102 is adapted for engaging and attaching with the insulated double-wall-construction base member 106. In this embodiment, the rigid container lid 102 engages a smooth upper rim of the insulated double-wall-construction base member 104. In other embodiments, the rigid container lid 102 may extend beyond the smooth upper rim of the insulated double-wall-construction base member 104 to shield an exposed edge of a shuttle member lid 112 from dirt or other contaminants.

The insulated double-wall-construction base member is comprised of sealed, double walls 103, 105 and preferably of stainless-steel construction, and it is attached to two latch members 108, 110 (only one latch member visible). The insulated double-wall-construction base member 104 is also dome shaped for this embodiment, but other shapes may be used. The sidewalls 103, 105 and the base 107 of the insulated double-wall-construction base member 104 are double-walled with vacuumed space in between the walls to allow for retention of temperature of items that is stored within the insulated double-wall-construction base member. The insulated double-wall-construction base member has a shaped bottom surface 109 with finger-grip ridges 111, some of which can be seen in FIG. 1 The finger-grip ridges 111 allow for easy gripping of the modular, insulated combination meal and to-go box 100 when the insulated double-wall-construction base member 104 and the rigid container lids 102 are sealed together. The insulated double-wall-construction base member 104 may be preferably made of stainless-steel, but other materials known in the art may be used. The sliding latch 108 (and a rail body portion 114 thereof), and the hinged partial loop 116 of the latch member can be seen in FIG. 1. While a latch member 108 is used to secure the insulated double-wall-construction base member 104 to the rigid container lid 102, other means of attachment known in the art may also be used.

A side view of the embodiment in FIG. 1 is shown in FIG. 2. The side views of the two latch members 108, 110 can be seen. The latch member 108 of the left is shown with the hinged partial loop 116 rotated upwards, in two possible positions, one dotted and one in solid lines. The arrow indicates the direction of the rotation. The hinged partial loop 116 is attached to the rail body 114 of the latch member 108, 110 by a pivot shaft 118 (not shown), which is longer than the rail body to allow for an attachment of the hinged partial loop to the pivot shaft. The upward rotation of the hinged partial loop 116 allows a user to attach a carrying strap 120 or a carabiner 121 to the modular, insulated combination meal and to-go box 100, for easy carriage and storage of the modular, insulated combination meal and to-go box. The finger-grip ridges 111 on the insulated double-wall-construction base member can be clearly seen in FIG. 2. While there are four finger-grip ridges 111 seen in FIG. 2, there may be more or a smaller number of finger-grip ridges 111 in another embodiment.

FIG. 3 shows a top view of an embodiment of the modular, insulated combination meal and to-go box 100 of FIGS. 1-2. The rigid container lid 102 removed and placed to the side of the insulated double-wall-construction base member 104. The rigid container lid 102 showing its top side in FIG. 3. A flat, outer surface 106 with a boundary on the top of the rigid container lid is shown. This surface may be used for printing or etching of indicia 124, or for placement of a sticker with indicia upon. The rigid container lid 102 may be see-through to allow viewing some of contents within the modular, insulated combination meal and to-go box, or it could be opaque and not see-through. The rigid container lid 102 is shaped to allow for a space within, to allow for space for a utensil tray 126 and its contents to be stored within the space. With the rigid container lid 102 removed, utensils 128, a utensil strap 139, a utensil tray 126, and a gasket 130 can be seen contained within the insulated double-wall-construction base member 104 with two latch members 108, 110. The top 132 of the sliding latch of the latch members 108, 110 can be seen in FIG. 3. The sliding latch 108, 110 may have a slot 134 to allow grip of the sliding latch to slide the sliding latch back and forth.

An optional utensil strap 139 is shown in the embodiment in FIG. 3. The utensil strap 139 removably attaches with the utensil tray 126 to allow for secure placement of the utensils 128 to ensure that the utensils stay in place while the modular, insulated combination meal and to-go box 100 is carried from one place to another. The utensil tray 126 may be optionally magnetic, allowing metal utensils 128 or utensil straps 139 to removably attach and stay in place while the modular, insulated combination meal and to-go box 100 is carried or tilted. The utensil strap 139 may be metal, stainless-steel, thermoplastic, food-grade silicone, or any other material known in the art. The utensil tray 126 is preferably thermoplastic, but other materials known in the art, such as stainless-steel, may be used.

In this embodiment, the outer peripheral rim 138 of the utensil tray has a plurality of openings 140 to allow a plurality of knobs 142 on the gasket to be inserted and retained within to form a sealed gasket-tray unit 144. In this embodiment, there are 10 knobs 142 of the gasket 130 and 10 openings 140 of the utensil tray 126. However, other number of knobs 142 and openings 140 may be used. The gasket 130 is shaped on an underside of the utensil tray 126 and it nests on top of the shuttle member lid 112 (not shown) when the shuttle member lid is retained within the modular, insulated combination meal and to-go box 100. In this embodiment, both the gasket 130 and the utensil tray 126 are elliptical in shape to fit within the dome-shaped rigid container lid 102 and the insulated double-wall-construction base member 104. Other shapes that correspond to the shapes of the rigid container lid 102 and the insulated double-wall-construction base member 104 may be used. The gasket 130 is preferably made of food-grade silicone, but other suitable materials known in the art may be used. The sealed gasket-tray unit 144 and the rigid container lid 102 can be combined to form a double-walled construction unit 146 (shown in FIG. 14) that further insulates the items stored within the modular, insulated combination meal and to-go box 100.

FIG. 4 is a bottom view of an embodiment of the modular, insulated combination meal and to-go box 100 in FIGS. 1-3, showing the insulated double-wall-construction base member 104 with two latch members 108, 110 attached. The bottom views of the hinged partial loops 116 of the two latch members 108, 110 can be seen. The shaped bottom surface 109 with finger-grip ridges 111 on the outer base 105 of the insulated double-wall-construction base member 104 are shown. Non-slip materials, such as silicone, can be added to the finger-grips 111 to decrease slippage of the modular, insulated combination meal and to-go box 100.

FIG. 5 is a perspective view of an embodiment of the modular, insulated combination meal and to-go box 100 in FIGS. 1-4. The rigid container lid 102 and the insulated double-wall-construction base member 104 with the two latch members 108, 110 (only one latch member visible) can be seen. FIG. 5 provides a perspective view of the hinged partial loop 116 of the latch member 108, 110 rotated upwards (though both of the latch members need not have a hinged partial loop. The rotation of the hinged partial loop 116 on the pivot shaft 118, the end of which can be seen in FIG. 5, allows for easier carriage of the modular, insulated combination meal and to-go box 100. A carrying strap 120 or a carabiner 121, or any other known attachment means, can be used for this purpose. While the hinged partial loop 116 of the latch member 108, 110 rotates, the rail body 114, a portion of which can be seen in FIG. 5, is attached to the external sidewalls 105 of the insulated double-wall-construction base member 104 and held in place. The pivot shaft 118 is longer than the length of the rail body 114. For this embodiment, the pivot shaft 118 is inserted through the hole 117 defined within the rail body 114 (Seen in FIG. 18) and through the holes 117 defined within the hinged partial loop 116 (Seen in FIG. 18). Other means of attaching the pivot shaft 118 to the rail body 114 or the hinged partial loop 116 may be used. While one pivot shaft 118 is used in this embodiment, there may be multiple pivot shafts in another embodiment. Other means of rotatably attaching the hinged partial loop 116 to the rail body 114 may be used.

FIG. 6 shows an exploded view of the embodiment of the modular, insulated combination meal and to-go box 100 shown in FIGS. 1-5. A hook 148 on the rigid container lid 102 can be seen. The rigid container lid 102 may have a plurality of hooks 148 for engaging with a sliding latch 132 of the latch member 108, 110. In this embodiment, there are two hooks 148 (only one visible in FIG. 6). However, other number of hooks 148 may be used. The insulated double-wall-construction base member 104 attached to the two latch members 108, 110 are also shown. The insulated double-wall-construction base member 104 is comprised of a double-wall-construction base 107 and double-wall-construction sidewalls 113, 115 (FIG. 14). In this embodiment, the double-wall-construction side wall 113, 115 is continuous because of the dome shape of the insulated double-wall-construction base member 104. The double-wall-construction base 107 is flat and also elliptical in shape for this embodiment. The insulated double-wall-construction base member 104 has an open top portion and acts as a bowl for any food or any other items stored within. The top portion 150 comprises a smooth upper rim 151. The smooth upper rim 151 engages and seals with the rigid container lid 102 when the sliding latches 108, 110 are locked.

FIG. 6 further shows how the elements of an embodiment of the modular, insulated combination meal and to-go box 100 may be combined into a unit. A utensil strap 139, utensils 128, a utensil tray 126, a gasket 130, a shuttle member lid 112, and a shuttle member 152 are also shown. The utensil tray 126 in this embodiment has two square grooves 154 in its surface to allow for easy removal of utensils 128 and non-through holes 156 to allow for protruding portions 158 of the utensil strap 139 to be clicked down. Other means of attachment of utensil strap 139 to the utensil tray 126 may be used. The shuttle member 152 fits into an inner concave shape of the insulated double-wall-construction base member 104. The shuttle member 152 is pliable, washable, reusable and collapsible. In this embodiment, the shuttle member's sidewalls 160 are made of multiple corrugated folds or hinges 162 that are adapted for collapsibility. The shuttle member 152 is preferably made of food-grade silicone, but other materials known in the art may be used. The shuttle member 152 has upper edges 164 that removably connect and seal with the shuttle member lid 112. The shuttle member lid 112 has a top side and a bottom side. The top side may have an upper side 166 that is shaped to fit adjacent and under the bottom 168 of the gasket 130, as it does in this embodiment. The shuttle member lid 112 further preferably has two grab/alignment members 169 jutting out from the top of the shuttle member lid adapted for being grabbed by a user and to align with grooves in the underside of the utensil tray 126. The shuttle member lid 112 may have a sealing groove at an inner portion thereof that seals with the upper edges of the shuttle member 152. The shuttle member lid 112 is preferably made of food-grade silicone, but other suitable materials known in the art may be used.

As shown in further detail in FIG. 20, the shuttle lid 112 may, in an embodiment, seal with a sealing groove 177 to upper wall portions 175 of the shuttle member 152 as shown. Further, as shown in FIG. 21, the shuttle lid 112 may optionally have an outer sealing groove 171 for sealing upper wall portions 150 and rim 151 of the insulated double-wall-construction base member 104, and an inner sealing groove 173 for sealing upper wall portions of the shuttle member 152. Thus, the shuttle lid 112 may seal either, or both simultaneously, the shuttle 152 and/or the insulated double-wall-construction base member 104 as shown in FIGS. 21-23.

The shuttle member 152 can have multiple configurations within and without the insulated double-wall-construction base member 104. In a first configuration, the shuttle member 152 can be collapsed to a flat state (e.g., in FIG. 8, the shuttle member is more collapsed), the shuttle member fitting closely with the shuttle member lid 112 to provide a unified lid for the insulated double-wall-construction base member 104. This configuration also allows for space to store a removable divider 170, shown in FIG. 6 next to the insulated double-wall-construction base member 104. In a second configuration, the shuttle member 152 is extended to substantially fill a volume of the inner concave shape of the insulated double-wall-construction base member 104. In this configuration, the shuttle member 152 can be used as a washable bowl, so the insulated double-wall-construction base member 104 does not need to be washed after food storage. In this configuration, the upper edges 164 of the shuttle member 152 fit closely with the sealing groove of the shuttle member lid 112. The removable divider 170 can be removed or laid down within the insulated double-wall-construction base 104 member for this configuration. In a third configuration, the shuttle member 152 is extended to any of multiple volume shapes of the shuttle member, and the shuttle member is kept outside of the insulated double-wall-construction base member 104.

FIG. 7 and FIG. 8 are exploded front view and side view, respectively, of an embodiment of the modular, insulated combination meal and to-go box 100 in FIGS. 1-6, showing the rigid container lid 102, the utensil strap 139, the utensil tray 126, the gasket 130, the shuttle member lid 112, the shuttle member 152, the removable divider 170, and the insulated double-wall-construction base member 104 attached to two latch members 108, 110 (only one latch member is visible in FIG. 7). Utensils 128 are not shown. Like FIG. 6, the order in which the components can be combined are shown. The modular, insulated combination meal and to-go box 100 can be assembled with some of its components not included, such as the removable divider 170, utensils 128, shuttle member 152, and shuttle member lid 112, or utensil straps 139. In this embodiment, the double-walled construction unit 101 (FIG. 14) formed by the combination of the rigid container lid 102 and gasket-tray unit 144 is integral in insulating and regulating the temperature along with the insulated double-wall-construction base member 104 within the modular, insulated combination meal and to-go box 100. The removable divider 170 is made of food-grade silicone, but other suitable materials known in the art may be used.

FIG. 9 is a perspective view of an embodiment of the shuttle member lid 112 and the shuttle member 152 of the modular, insulated combination meal and to-go box 100 in FIGS. 1-8. This embodiment of the shuttle member lid 112 comprises a top side 172 and a bottom side 174. In an embodiment, the bottom side 174 (not shown) of the shuttle lid 112 may comprises a sealing lip (not shown) extending inwardly from an overhanging side edge 167 of the shuttle lid and adapted to seal with a corresponding engagement lip of the upper edge 164 of the shuttle member 152. In an embodiment, the shuttle member lid may further comprise an outer groove 171 (see FIGS. 21 and 23) adapted to seal with the smooth upper rim 151 of the insulated double-wall-construction base member 104. In a primary embodiment, e.g., as shown in FIG. 8, the shuttle member lid 112 may only fit the upper edges of the shuttle member 152 and may not engage with the smooth upper rim 151 of the insulated double-wall-construction base member 104. As seen in FIGS. 6-8, the shuttle member 152 fits into an inner concave shape of the insulated double-wall-construction base member 104. This allows the double wall construction of the rigid lid 102 and utensil tray 126 combination (as sealed with the gasket 130) to seal down against the upper rim 151 of the insulated double-wall-construction base member 104. The shuttle member 152 is preferably pliable, washable, reusable and collapsible. In this embodiment, the shuttle member's sidewalls 160 are also made of multiple hinges 162 that are adapted for collapsibility. The shuttle member 152 and the shuttle member lid 112 are preferably made of food-grade silicone, but other suitable materials known in the art may be used. The shuttle member can be in multiple configurations as described above.

FIG. 10 is a side view of an embodiment of the shuttle member lid 112' and the shuttle member 152' of the modular, insulated combination meal and to-go box 100 in FIGS. 1-8. As seen in FIGS. 6-8, the shuttle member 152' fits into an inner concave shape of the insulated double-wall-construction base member 104. The shuttle member 152' is pliable, washable, reusable and collapsible. In this embodiment, the shuttle member's sidewalls 160 are also made of multiple hinges 162 that are adapted for collapsibility. The shuttle member 152' and the shuttle member lid 112' are preferably made of food-grade silicone, but other suitable materials known in the art may be used.

FIG. 10 shows that the shuttle member lid 112' in this embodiment comprises a top side 172, a bottom side 174, and a circumferential mote 176 on the top side of the shuttle member lid, formed by inner and outer circumferential mote sidewalls 178, 180. The sectionals of the circumferential mote 176 may be seen at the peripheries of FIG. 10, in dotted lines. The shuttle member lid 112' in this embodiment is placed within the upper edges 164' of the shuttle member 152', and therefore are represented in dotted lines. The mote 176 may be multiple motes and be located on two opposite ends of the shuttle member lid 112' or be one continuous mote that covers the entire periphery of the shuttle member lid. The outer mote side wall 178 forms a circumferential ridge 182 adapted for being received and removably retained in a circumferential groove 184 formed in an upper wall portion 164' of the shuttle member 152'.

The circumferential ridge 182 is shown in FIG. 10 as dotted arrows on both ends of the shuttle member lid 112' shown. Because the shuttle member 152' is designed to be collapsible, putting vertical force upon the shuttle member lid 112' may cause the shuttle member 152' to compress vertically, making spillage possible. The circumferential ridge 182 and the circumferential groove 184 allows for easy attachment and detachment of the shuttle member lid 112' from the shuttle member 152' to prevent compressing of the shuttle member while attaching or detaching the shuttle member lid to prevent collapse and spillage of any items within the shuttle member. For example, a user can place his fingers (or a thumb) into the mote 176 (or motes, if multiple), and use a pinching motion to compress the shuttle member lid 112' horizontally to unseal or seal the circumferential ridge 182 from the circumferential groove 184, thereby avoiding putting vertical force upon the shuttle member lid. The shuttle member 152' can be in multiple configurations described above.

FIG. 11 is a sectional view of the shuttle member lid 112' and the shuttle member 152' of the modular, insulated combination meal and to-go box in FIGS. 1-8 as the shuttle member 152' is comprised in FIG. 10. FIG. 11 clearly shows how the circumferential ridge 182 of the shuttle member lid 112', shaped as arrows, seals with the circumferential groove 184 of the shuttle member 152'. Within this sectional view, the top side 172, the bottom side 174, and the circumferential mote 176 on the top side of the shuttle member lid 112' can be clearly seen. The circumferential mote 176 is formed by the inner and outer circumferential mote sidewalls 178, 180. The circumferential ridge 182 of the shuttle member lid 112' is positioned perpendicular to the outer peripheral wall 178 of the circumferential mote 176 and forms a seal with the circumferential groove 184 of the shuttle member. The circumferential ridge 182 is also perpendicularly positioned relative to the upper wall edges 164' of the shuttle member 152' when sealed.

FIG. 12 is a top view of an embodiment of the gasket 130 of the modular, insulated combination meal and to-go box 100 in FIGS. 1-9. The plurality of knobs 142 that are to be inserted and retained within the plurality of openings 140 of the utensil tray 126 can be seen. As described previously, this embodiment has 10 such knobs 142, but other number of knobs and opening 140 combinations may be used. The gasket 130 is designed to fit the underside of the utensil tray 126, around the utensil tray's outer peripheral rim 138. The gasket 130 and the utensil tray 126 combine to form the sealed gasket-tray unit 144 (see FIG. 14) because of the plurality of knobs 142 and the plurality of openings 140. The embodiment in FIG. 12 shows a gasket 130 that is ellipsoid, to fit within and with the shapes of the rigid container lid 102 and the insulated double-wall-construction base member 104. The gasket 130 embodiment in FIG. 12 also shows the inner circumference of the gasket to be angled so the plurality of knobs 142 can be fit tightly into the plurality of openings 140 to form a seal. Further, the gasket 130 embodiment in FIG. 12 has sealing ridges 186 along its outer circumference to seal tightly with the rigid container lid 102. Other means of sealing the rigid container lid 102 to the gasket 130 may be used. The gasket 130 can be of different shape and size as needed.

FIG. 13 shows bottom views of an embodiment of the rigid container lid 102, the gasket 130, and the utensil tray 126 of the modular, insulated combination meal and to-go box 100 in FIGS. 1-8, and FIG. 12. As described previously, the shuttle member lid 112, the utensil tray 126, and the gasket 130 may be combined to form a double-walled construction unit 101 to insulate food items when combined and sealed with the insulated double-wall-construction base member 104 using at least one latch member 108, 110. Because the gasket 130 is designed to sit on top of the shuttle member lid 112, there are no sealing ridges or mechanisms seen on the bottom side of the gasket. The bottom side of the utensil tray 126 is designed to allow for the gasket 130 to fit underside the utensil tray for a tight fit between the utensil tray and the gasket once all the plurality of knobs 142 of the gasket are inserted and retained within the plurality of openings 140 of the utensil tray.

FIG. 14 is a sectional view of the double-walled construction unit 101 and the insulated double-wall-construction base member 104 of the modular, insulated combination meal and to-go box 100 in FIGS. 1-8, 12-13. The combination of the gasket 130 (shown as two parts in FIG. 14 sectional view) and the utensil tray 126 (i.e., part of which is comprised of the third and fourth horizontal lines from the top of FIG. 14) forms the sealed gasket-tray unit 144. The sealed gasket-tray unit 144 and the rigid container lid 102 (i.e., part which is comprised of the first and second horizontal lines from the top of FIG. 14) forms the double-walled construction unit 101 when combined and sealed. Once so sealed, the double-walled construction unit 101 acts as one unit and can be placed on top of or removed from the top of the shuttle member lid 112 or the insulated double-wall-construction base member 104 (i.e., part of which is comprised of the first and second horizontal lines from the bottom of FIG. 14) as the double-walled construction unit 101 and not as individual parts (i.e., rigid container lid 102, utensil tray 126, and gasket 130. Manual force can be applied to separate the double-walled construction unit 101 into its individual parts (102, 126, 130) again. The sectional view of FIG. 14 shows that the insulated double-wall-construction base member 104 has vacuum space in between the double-wall-construction of its base 107 (comprised of base portions 103, 105) and sidewalls 113, 115. The space between the sealed gasket-tray unit 144 and the rigid container lid 102 serves as both a storage space for utensils and other meal related items (e.g., napkin) and as air filled space 188 that insulates the items stored below, either in the shuttle member 152, 152' (not shown) or the insulated double-wall-construction base member 104.

FIG. 15 is a side view of an embodiment of the modular, insulated combination meal and to-go box 100 in FIGS. 1-14, showing the rigid container lid 102 and the insulated double-wall-construction base member 104 combined with two latch members 108, 110. A hinged partial loop 116 of one of the latch members 108 is shown rotated upwards to allow for a carabiner 120 on a rope 120 to hook onto the hinged partial loop. This is one example of how the modular, insulated combination meal and to-go box 100 can be easily carried. In another embodiment, a carrying strap (not shown) or other means of carriage known in the art may be used. As also shown in FIG. 15, the combination meal and to-go box 100 preferably further comprises a shaped bottom surface 107, 109 defining a plurality of finger grip portions 111 to facilitate easier gripping of the combination meal and to-go box 100 as shown in FIG. 16.

FIG. 16 is a side perspective view of an embodiment of the modular, insulated combination meal and to-go box 100 in FIGS. 1-15, showing the rigid container lid 102 and the insulated double-wall-construction base member 104 with the shaped bottom surface 109 with finger-grip ridges 111 combined with two latch members 108, 110 (only one latch member 108 is visible) being held by a hand. In this embodiment, there are four finger-grip ridges 111 to accommodate for fingers of a hand to comfortably grip the modular, insulated combination meal and to-go box 100. The finger-grip ridges 111 are linear in this embodiment, but other suitable shapes for finger gripping may be used. The finger-grip ridges 111 can be of different sizes and numbers than shown in this embodiment.

FIG. 17 is a perspective view of an embodiment of the modular, insulated combination meal and to-go box 100 in FIGS. 1-17, showing the rigid container lid 102 and the insulated double-wall-construction base member 104 combined with two latch members 108, 110 (only one latch visible). In this embodiment, the latch members 108, 110 are shown as exploded to show all the parts. The left most part in this exploded view is a hinged partial loop 116. The shape of the hinged partial loop 116 is designed to cover at least a portion of the rail body 114. The top portions of the partial loop 116 and the rail body 114, in this embodiment, have two holes 117 to attach to the pivot shaft 118 passing through the rail body 114. This attachment to the pivot shaft 118 allows for upward rotation of the hinged partial loop 116. A carrying means, such as a carrying strap 120 or a carabiner 121 may be attached to the hinged partial loop 116.

Second to the left are shown four bolts 190 as attachment means to attach the rail body 114 to four corresponding weld nuts 192 attached to the insulated double-wall-construction base member 104 external side wall 115. Third to the left in the exploded portion of FIG. 17 is an embodiment of the rail body 114 with at least one bar 194 on top of the rail body. Preferably, as shown in FIG. 17, there are at least two such bars 194. The rail body 114 also has side wings 196 with two holes each to allow for the four bolts 190 to affix the rail body to the insulated double-wall-construction base member 104 via the four corresponding weld nuts 192. Fifth from the left in the exploded portion of FIG. 17 is an embodiment of the sliding latch 132, designed to attach to the two bars 194 of the rail body 114. The sliding latch 132 is capable of sliding sideways on the two bars 194 to release or combine with one of the hooks 148 of the plurality of hooks 148 on the rigid container lid 102 to seal or unseal the rigid container lid to the insulated double-wall-construction base member 104. The pivot shaft 118 is shown separately from the rail body 114, just in front of the sliding latch 132. FIG. 17 also shows that indicia 124 may be engraved or otherwise marked or affixed on the rigid container lid 102, as described previously.

FIG. 18 are exploded and partially assembled views of embodiments of the preferred latches 108, 110 of the modular, insulated combination meal and to-go box 100 in FIGS. 1-17. The exploded latch member 108, 110 shows a rail body 114 with two bars 194 on the top, a pivot shaft 118 separated from the rail body 114, a sliding latch 132 unattached to the two bars 194 on the rail body, a hinged partial loop 116, and four bolts 190. The rail body 114 is designed so that the pivot shaft 118 can be inserted through the rail body at holes 117. The pivot shaft 118 is longer than the length of the rail body 114 to allow for the hinged partial loop 116 to also attach to the pivot shaft. In this embodiment, the hinged partial loop 116 attaches by inserting the pivot shaft 118 through the two holes 117 on the either side of the hinged partial loop. The hinged partial loop 116 is designed to cover a portion of the rail body 114. In this embodiment, the portion so covered are the two wings 196 on the side of the rail body 114 that allows for the bolts 190 to be inserted to affix the rail body to the insulated double-wall-construction base member 104.

The partially assembled view in FIG. 18 shows how the latch member 108, 110 components are combined to form a working latch. The length of the pivot shaft 118 is shown in dotted lines to indicate that it is contained within the rail body 114 and the top portion of the hinged partial loop 116. The parts of the rail body 114 that are covered by the hinged partial loop 116 are shown in dotted lines. The bolts 190 are also shown in dotted lines since they will be hidden behind the hinged partial loop 116 in a non-rotated position. Any other attachment means known in the art may be used to attach the rail body 114 to the insulated double-wall-construction base member 104. The pivot shaft 118 may be multiple pivot shafts. Other means of attachment besides pivot shafts 118 that allow the hinged partial loop 116 to rotate may be used. The latch member 108, 110 may be made of thermoplastic, or any other materials known in the art. The latch member can be see-through for a high-tech appearance. The flat surface of the rail body 114 may be used for etching or printing indicia in other embodiments.

FIG. 19 is a front view of an embodiment of the modular, insulated combination meal and to-go box 100 in FIG. 1-18, with a sliding latch 132 slid to a side and the rigid container lid 102 unlocked and lifted from the insulated double-wall-construction base member 104. The sliding latch is sliding on at least one bar (two in this embodiment) of the rail body of the latch member. The sliding latch 132 can release or combine with one of hooks 148 of the plurality of hooks 148 on the rigid container lid 102 to seal or unseal the rigid container lid to the insulated double-wall-construction base member 104. In FIG. 19, one of the hooks 148 can be seen on the rigid container lid 102. The sliding latch 108, 110 remains attached to the bar 194 of the rail body 114 as shown and described previously.

One of ordinary skill in the art will recognize the inventive principles disclosed are not limited to the embodiments disclosed herein, and that various aspects of the disclosed embodiments can be combined to achieve additional embodiments.

In the preceding description, numerous details were set forth. It will be apparent, however, to one skilled in the art, that the present invention may be practiced without some of these specific details. While a preferred embodiment of the present disclosure has been shown and described, it will be apparent to those skilled in the art that many changes and modifications may be made without departing from the claimed subject matter in its broader aspects. For example, it will be appreciated that one of ordinary skill in the art may mix and match the various components of the various embodiments of the claimed subject matter without departing from the true spirit of the claims. The appended claims are therefore intended to cover all such changes and modifications as fall within the true spirit and scope of the invention.

What is claimed is:

1. A modular, insulated combination meal and to-go box adapted for facilitating ecologically responsible and reusable storage and transport of food and other items, comprising:

a. An insulated double-wall-construction base member having a double-wall-construction base and double-wall-construction sidewalls having a top portion, said insulated double-wall-construction base member open at the top portion and further comprising a smooth upper rim at the top portion, said insulated double-wall-construction base member adapted for holding solids and liquids and being insulated by a vacuum within the double-wall-construction base and the double-wall-construction sidewalls of said insulated double-wall-construction base member;

b. A removable divider adapted for separating food or other items within said insulated double-wall-construction base member;

c. A pliable, washable, reusable, collapsible shuttle member, said shuttle member further comprising upper edges and a shuttle member lid comprising a top side and a bottom side, the bottom side comprising a sealing groove at an inner portion thereof and adapted to seal with the upper edges of said shuttle member, the shuttle member lid further comprising an outer portion thereof adapted to seal with the smooth upper rim of said insulated double-wall-construction base member, said shuttle member being adapted to expand and collapse to provide multiple configurations and uses within or without said insulated double-wall-construction base member, the multiple configurations comprising:

i. A first configuration wherein said shuttle member is collapsed to a flat state, said shuttle member fitting closely with the shuttle member lid to provide a unified lid for said insulated double-wall-construction base member while preserving space for use of said removable divider;

ii. A second configuration wherein said shuttle member is extended to substantially fill a volume of an inner concave shape of said insulated double-wall-construction base member, said shuttle member thus providing a washable bowl, the upper edges of said shuttle member fitting closely with the sealing groove at the inner portion of the shuttle member lid adapted to seal any items within said shuttle member, such configuration involving a removal or laying down of said removable divider; and iii. A third configuration wherein said shuttle member is adapted to be extended to any of multiple volume shapes of said shuttle member outside of said insulated double-wall-construction base member, said shuttle member thus providing a means of storing food and other items in a location separate from said insulated double-wall-construction base member, said shuttle member thus being adapted for storage such as within a refrigerator, or for heating food items in a microwave or conventional oven within said shuttle member, the shuttle member lid also being available to seal said shuttle member when said shuttle member is outside of said insulated double-wall-construction base member.

2. A modular, insulated combination meal and to-go box adapted for facilitating ecologically responsible and reusable storage and transport of food and other items, comprising:

a. An insulated double-wall-construction base member having a double-wall-construction base and double-wall-construction sidewalls having a top portion, said insulated double-wall-construction base member open at the top portion and further comprising a smooth upper rim at the top portion, said insulated double-wall-construction base member adapted for holding solids and liquids and being insulated by a vacuum within the double-wall-construction base and the double-wall-construction sidewalls of said insulated double-wall-construction base member;

b. A pliable, washable, reusable, collapsible shuttle member, said shuttle member further comprising a shuttle member lid comprising a top side and a bottom side, the bottom side comprising a sealing ridge adapted to seal with a sealing groove of upper edges of said shuttle member, the shuttle member lid being thus adapted for sealing and protecting any items within said shuttle member and said insulated double-wall-construction base member against contamination and maintaining thermal insulation when the shuttle member lid and said shuttle member are engaged in a closing relationship with said insulated double-wall-construction base member, said shuttle member being adapted to expand and collapse to provide multiple configurations and uses within or without said insulated double-wall-construction base member, the multiple configurations comprising:

i. A first configuration wherein said shuttle member is collapsed to a flat state, said shuttle member fitting closely with the shuttle member lid to provide a unified lid for said insulated double-wall-construction base member;

ii. A second configuration wherein said shuttle member is extended to substantially fill a volume of an inner concave shape of said insulated double-wall-construction base member, said shuttle member thus providing a washable bowl, the upper edges of said shuttle member fitting closely with the sealing ridge of the shuttle member lid to seal any items within said shuttle member;

iii. A third configuration wherein said shuttle member is extended to any of multiple volume shapes of said shuttle member outside of said insulated double-wall-construction base member, said shuttle member thus providing a means of storing food and other items in a location separate from said insulated double-wall-construction base member, said shuttle member thus being adapted for storage such as within a refrigerator, or for heating food items in a microwave within said shuttle member, the shuttle member lid also being available to seal said shuttle member when said shuttle member is outside of said insulated double-wall-construction base member;

c. A rigid container lid, adapted for engaging and attaching to said insulated double-wall-construction base member to provide convenient carrying and protection of said shuttle member within said insulated double-wall-construction base member, wherein said rigid container lid is adapted to engage the smooth upper rim of said insulated double-wall-construction base member in such a manner as to secure said shuttle member and the shuttle member lid within said insulated double-wall-construction base member when combined;

d. A utensil tray adapted for holding of reusable utensils and other meal-related items within a space of said rigid container lid and above the shuttle member lid;

e. At least one latch member attached to said insulated double-wall-construction base member, wherein said at least one latch member is adapted for securing said rigid container lid to said insulated double-wall-construction base member;

f. A flat surface on one of said insulated double-wall-construction base member and said rigid container lid, adapted for printing of indicia thereon for marketing and branding purposes.

3. The modular, insulated combination meal and to-go box of claim 1, further adapted for easy cleaning and re-use for supporting ecological best practices and avoiding use of single-use disposable containers.

4. The modular, insulated combination meal and to-go box of claim 2, wherein: the shuttle member lid further comprises a circumferential mote on the top side of the shuttle member lid, formed by inner and outer circumferential mote sidewalls, the outer mote side wall forming a circumferential ridge adapted for being received and removably retained in a circumferential groove formed in an upper wall portion of said shuttle member, wherein the circumferential ridge and circumferential groove is adapted for easy attachment and detachment of the shuttle member lid from said shuttle member to prevent compressing of said shuttle member while attaching or detaching the shuttle member lid to prevent collapse and spillage of any items within said shuttle member, and wherein the circumferential ridge of the shuttle member lid is positioned perpendicular to an outer peripheral wall portion of the circumferential mote and forms a seal with the circumferential groove of said shuttle member, the circumferential ridge being perpendicularly positioned relative to the upper wall portion of said shuttle member when sealed.

5. The modular, insulated combination meal and to-go box of claim 2, wherein said rigid container lid further comprises a dome shape and a plurality of hooks along a periphery of said rigid container lid, and wherein said at least one latch member comprises a plurality of latch members, each of said plurality of latch members aligned and corresponding to one of said plurality of hooks, and wherein each of said plurality of latch members is adapted for sliding relative to said insulated double-wall-construction base member and said rigid container lid such that an engagement portion of each said plurality of latch members engage with a corresponding one of said plurality of hooks.

6. The modular, insulated combination meal and to-go box of claim 2, wherein said utensil tray further comprises an outer peripheral rim, the outer peripheral rim defining a plurality of openings there along; and said modular, insulated combination meal and to-go box further comprising a gasket shaped on an underside of the outer peripheral rim of said utensil tray to nest on top of the shuttle member lid when the shuttle member lid is retained within said modular, insulated combination meal and to-go box, an upper side of the shuttle member lid being shaped to fit adjacent and under a circumferential bottom portion of said gasket, said gasket further comprising a plurality of knobs adapted for insertion and retention within the plurality of openings defined on the outer peripheral rim of said utensil tray to form a sealed gasket-tray unit for sealing with the periphery of said rigid container lid, wherein a sealed combination of said rigid container lid and said sealed gasket-tray unit form a double-walled construction unit that further insulates when combined with said insulated double-wall-construction base member using said at least one latch member.

7. The modular, insulated combination meal and to-go box of claim 6, wherein utensils are adapted for being retained on said utensil tray between said rigid container lid and said sealed gasket-tray unit.

8. The modular insulated combination meal and to-go box of claim 7, wherein on one of the shuttle member lid, said insulated double-wall-construction base member, said rigid container lid, and the double-walled base of said insulated double-wall-construction base member, comprises an outer surface adapted for one of printing of indicia thereon or application of a sticker with indicia thereon, for marketing and branding to allow customers such as grocery retail outlets, restaurants, universities, or leisure activity retailers to promote an environment-friendly message.

9. The modular, insulated combination meal and to-go box of claim 6, said insulated double-wall-construction base member further comprising a shaped bottom surface with finger-grip ridges adapted for more comfortable and secure holding of said insulated double-wall-construction base member with said rigid container lid when combined.

10. The modular, insulated combination meal and to-go box of claim 6, further adapted for easy cleaning and re-use for supporting ecological best practices and avoiding use of single-use disposable containers.

11. The modular, insulated combination meal and to-go box of claim 5, each of said plurality of latch members comprising:

a. a rail body, at least one bar on a top of said rail body, and a pivot shaft that is longer than a length of said rail body;

b. a sliding latch that attaches to said at least one bar of said rail body, wherein said sliding latch is capable of sliding sideways on said at least one bar of said rail body to release or combine with one of the hooks of the plurality of hooks of said rigid container lid to seal said rigid container lid to said insulated double-wall-construction base member;

c. a hinged partial loop, shaped to cover at least a portion of said rail body, comprising a top portion that attaches to said pivot shaft passing through said rail body and enabling said hinged partial loop to rotate upwards on the pivot shaft to allow attachment to a carrying means such as a carry strap or a carabiner; and d. At least one attachment means that attach said rail body to said insulated double-wall-construction base member.

12. The modular, insulated combination meal and to-go box of claim 11, wherein said at least one attachment means of said plurality of latch member is at least one bolt that attaches to said insulated double-wall-construction base member by at least one weld nut.

* * * * *